US010925401B1

(12) United States Patent
Kassner

(10) Patent No.: US 10,925,401 B1
(45) Date of Patent: Feb. 23, 2021

(54) ADJUSTABLE CHAIR

(71) Applicant: Mattheson Ryan Kassner, Ottawa (CA)

(72) Inventor: Mattheson Ryan Kassner, Ottawa (CA)

( * ) Notice: Subject to any disclaimer, the term of this patent is extended or adjusted under 35 U.S.C. 154(b) by 0 days.

(21) Appl. No.: 16/586,378

(22) Filed: Sep. 27, 2019

(51) Int. Cl.
*A47C 3/18* (2006.01)
*A47C 7/02* (2006.01)

(52) U.S. Cl.
CPC . *A47C 3/18* (2013.01); *A47C 7/02* (2013.01)

(58) Field of Classification Search
CPC ..... A47C 3/18; A47C 7/02
USPC ..... 297/311, 344.21, 344.22, 344.24; 4/578.1
See application file for complete search history.

(56) References Cited

U.S. PATENT DOCUMENTS 5,097,542 A * 3/1992 Roesler ..... A47K 3/122 4/579
5,704,729 A * 1/1998 Carnahan ..... B23Q 1/28 248/425
5,720,462 A * 2/1998 Brodersen ..... B60N 2/143 248/425
5,822,809 A * 10/1998 Gallo ..... A47K 3/122 4/578.1
6,027,170 A * 2/2000 Benz ..... B60N 2/14 248/425
6,325,456 B1 * 12/2001 Carnahan ..... A47C 3/18 297/344.24
6,543,848 B1 * 4/2003 Suga ..... B60N 2/245 297/344.24
8,544,809 B1 * 10/2013 Laurita ..... A47B 91/005 248/346.06
8,899,682 B2 12/2014 Nilsson et al.
10,076,976 B2 * 9/2018 Roeglin ..... B60N 2/146
10,640,017 B2 * 5/2020 Murakami ..... B60N 2/0232
2003/0160488 A1 * 8/2003 Kim ..... B60N 2/146 297/344.22
2005/0179302 A1 * 8/2005 Chung ..... A47C 3/18 297/423.27
2010/0164265 A1 * 7/2010 Tomandl ..... B60N 2/3011 297/326
2011/0304187 A1 * 12/2011 Ross ..... A47C 1/14 297/344.24
2014/0138997 A1 * 5/2014 Schulz ..... B60N 2/07 297/344.24
2014/0292052 A1 * 10/2014 Parker ..... A47C 7/54 297/342

(Continued)

*Primary Examiner* — Mark R Wendell
(74) *Attorney, Agent, or Firm* — Sand, Sebolt & Wernow Co., LPA

(57) ABSTRACT

A chair for individuals with mobility challenges and a method of using such a chair. The chair may be adjusted relative to a horizontal work surface disposed a distance above a floor by placing a base of the chair on the floor a first distance away from an edge of the work surface; rotating a seat of the chair relative to the base from a neutral position to a first angled position. The individual sits in the seat when in the first angled position and the seat is then rotated relative to the base and back to the neutral position. An actuator is then engaged to enable the seat to slide linearly relative to the base and toward the work surface. The seat is able to be rotated and moved linearly relative to the work surface adjusting the position of the base on the floor.

17 Claims, 36 Drawing Sheets

(56) References Cited

U.S. PATENT DOCUMENTS

| | | | | |
|---|---|---|---|---|
| 2016/0374879 | A1* | 12/2016 | Christian | A47C 1/029<br>297/313 |
| 2019/0077280 | A1* | 3/2019 | Duriez | B60N 2/0705 |

* cited by examiner

ADJUSTABLE CHAIR

TECHNICAL FIELD

The present disclosure relates generally to chairs. More particularly, the present disclosure relates to an adjustable chair that is able to rotate and to move in a linear fashion relative to a base of the chair and without moving the base on a surface upon which the base rests. Specifically, the chair is able to be rotated about a vertical axis between a neutral position and a first extreme angle to the left and a second extreme angle to the right of the neutral position. A detent style locking mechanism is actuated to lock the chair in any of the neutral or angled positions. The chair is furthermore able to move linearly between a forward position and a rearward position. The chair is locked against rotational motion when moving linearly and is locked against linear motion when rotating.

BACKGROUND

Background Information

Senior citizens, intellectually and developmentally disabled individuals as well as individuals who have had a debilitating accident may have trouble moving themselves to and from a work surface, eating table, or other similarly situated surfaces. As a result, many of these individuals are incapable of eating a meal in a normal fashion or sitting or working at a traditional table surface. Many individuals are thus limited to TV-trays or smaller surfaces that lay across a bed or chair while working or eating as it is challenging for them to move closer to the table surface.

This problem has been addressed in the prior art by providing electronic and motor-driven devices that are attachable to a chair or other furniture that may help such individuals. However, the movable parts of such devices are usually mounted upon relatively complex support arrangements, typically made of steel or other heavy metals. Frequently, there may be a series of linkages that enable the movable part of the chair or other furniture to travel through the desired range of motion. Such support arrangements are often costly and heavy, thereby making transportation, shipping, handling, and use awkward of such devices.

Adjustment assemblies on PRIOR ART chairs typically include large open-slot channels through any adjustable components extend to the chair itself. These large open channels can cause injury to a user if his or her fingers get caught in the channels while adjusting the chair.

Additionally, there has tended to be too much range of motion with PRIOR ART chairs and this has proven to be especially problematic for individuals who are unable to adequately control their balance, leading to many falls, broken bones, and contusions.

SUMMARY

The adjustable chair disclosed herein addresses many of the shortcomings of PRIOR ART adjustable chairs.

A chair for individuals with mobility challenges and a method of using such a chair is disclosed. The chair may be adjusted relative to a horizontal work surface disposed a distance above a floor by placing a base of the chair on the floor a first distance away from an edge of the work surface; rotating a seat of the chair relative to the base from a neutral position to a first angled position. The individual sits in the seat when in the first angled position and the seat is then rotated relative to the base and back to the neutral position. An actuator is then engaged to enable the seat to slide linearly relative to the base and toward the work surface. The seat is able to be rotated and moved linearly relative to the work surface adjusting the position of the base on the floor.

In one aspect, an exemplary embodiment of the present disclosure may provide a chair, comprising a seat; a base adapted to rest on a surface; and an adjustment assembly operatively engaging the seat and the base; wherein the adjustment assembly enables the seat separately to rotate relative to the base about a vertical axis and move linearly with respect to the base along an axis oriented at right angles to the vertical axis; and wherein the rotational motion and linear motion of the seat relative to the base is accomplished without moving the base relative to the surface.

In one aspect, an exemplary embodiment of the present disclosure may provide a chair, comprising a seat; a base adapted to contact a surface; and an adjustment assembly operatively engaging the seat and base with each other; wherein the adjustment assembly comprises a first mechanism operative to rotate the seat with respect to the base about a vertical axis; and a second mechanism operative to move the seat linearly with respect to the base; and wherein at least one of the first mechanism and the second mechanism facilitates motion of the seat relative to the base from a reference position to one of a plurality of additional positions located remote from the reference position without moving the base relative to the surface.

In another aspect, an exemplary embodiment of the present disclosure may provide a method of adjusting a chair relative to a horizontal work surface disposed a distance above a floor comprising placing a base of the chair on the floor a first distance away from an edge of the work surface; rotating a seat of the chair relative to the base from a neutral position to a first angled position; causing an individual to sit in the seat; rotating the seat back to the neutral position from the first angled position; moving the seat linearly forwardly relative to the base and toward the edge of the work surface; wherein the rotating of the seat and the moving of the seat is accomplished without moving the base on the floor.

In one embodiment, the method further includes locking the seat in the first angled position prior to causing the individual to sit in the seat. The method may further include preventing rotation of the seat prior to moving the seat linearly relative to the base. The method may further include disengaging a locking mechanism that restrains the seat against linear motion prior to moving the seat linearly. The disengaging includes breaking an interlocking engagement between teeth of a lock teeth rail and teeth of a locking member.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
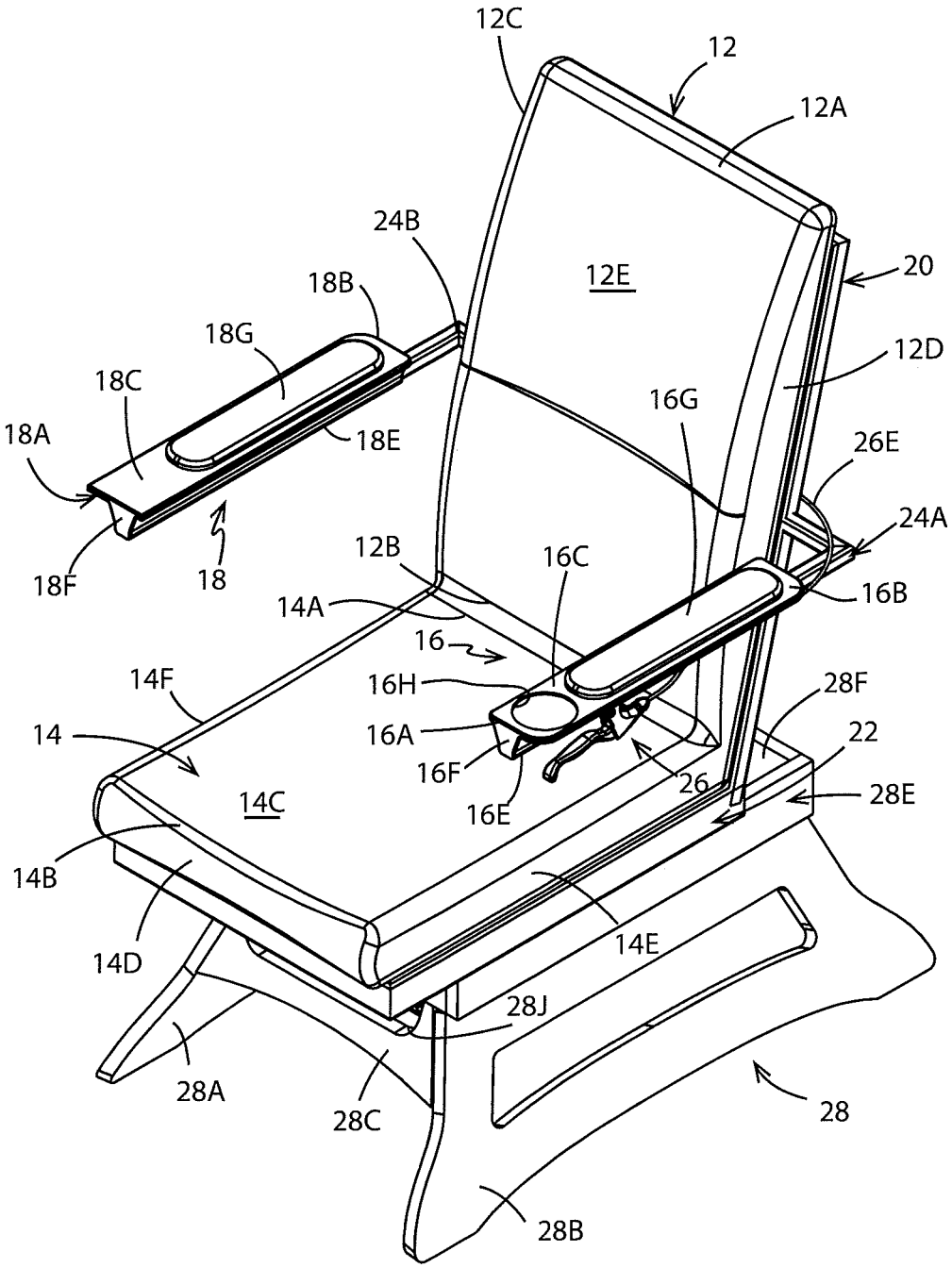
FIG. 1 (FIG. 1) is a top, front, right side perspective view of an exemplary chair in accordance with the present disclosure.
Figure 2:
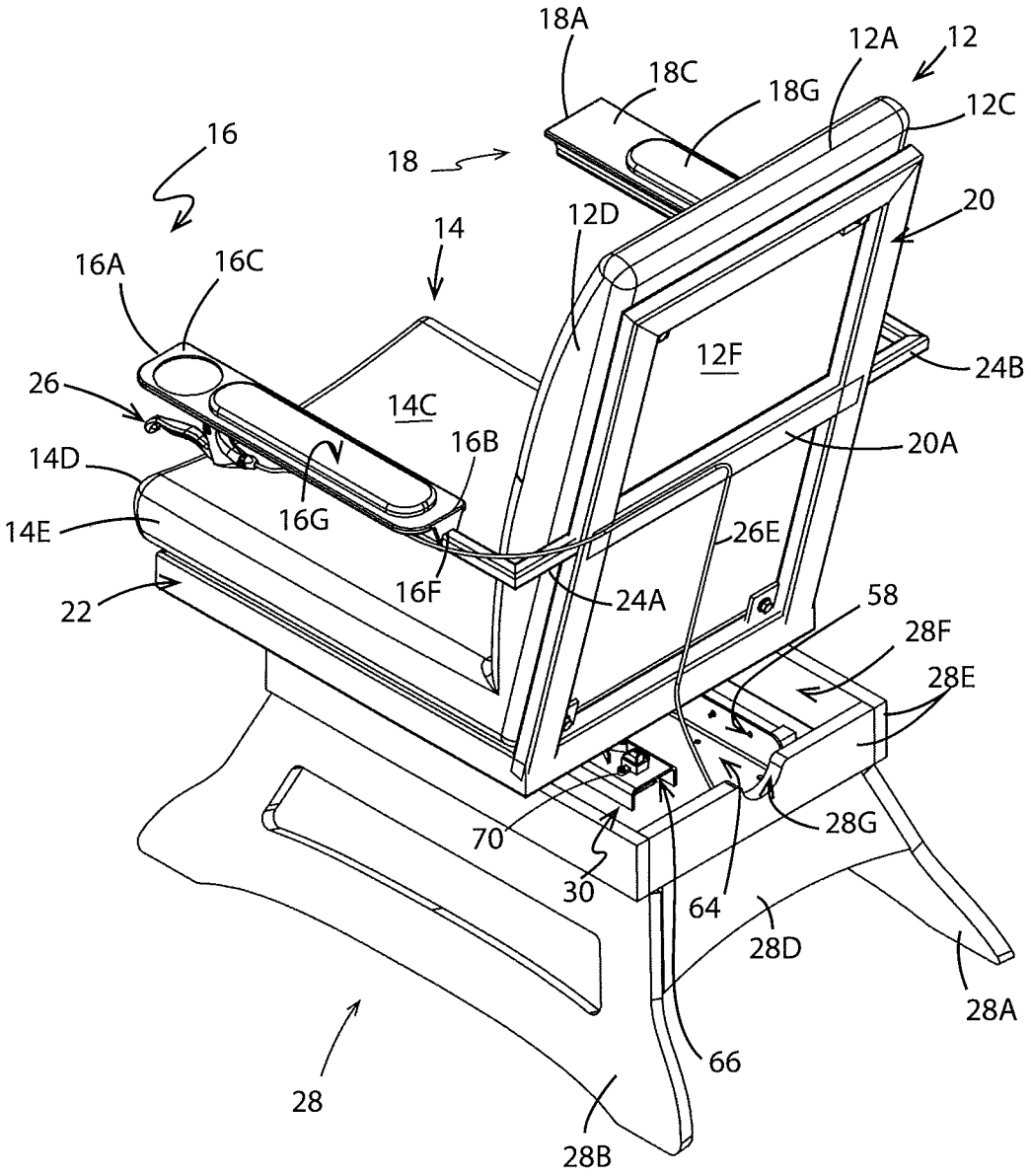
FIG. 2 (FIG. 2) is a top, back, right side perspective view of the exemplary chair.
Figure 3:
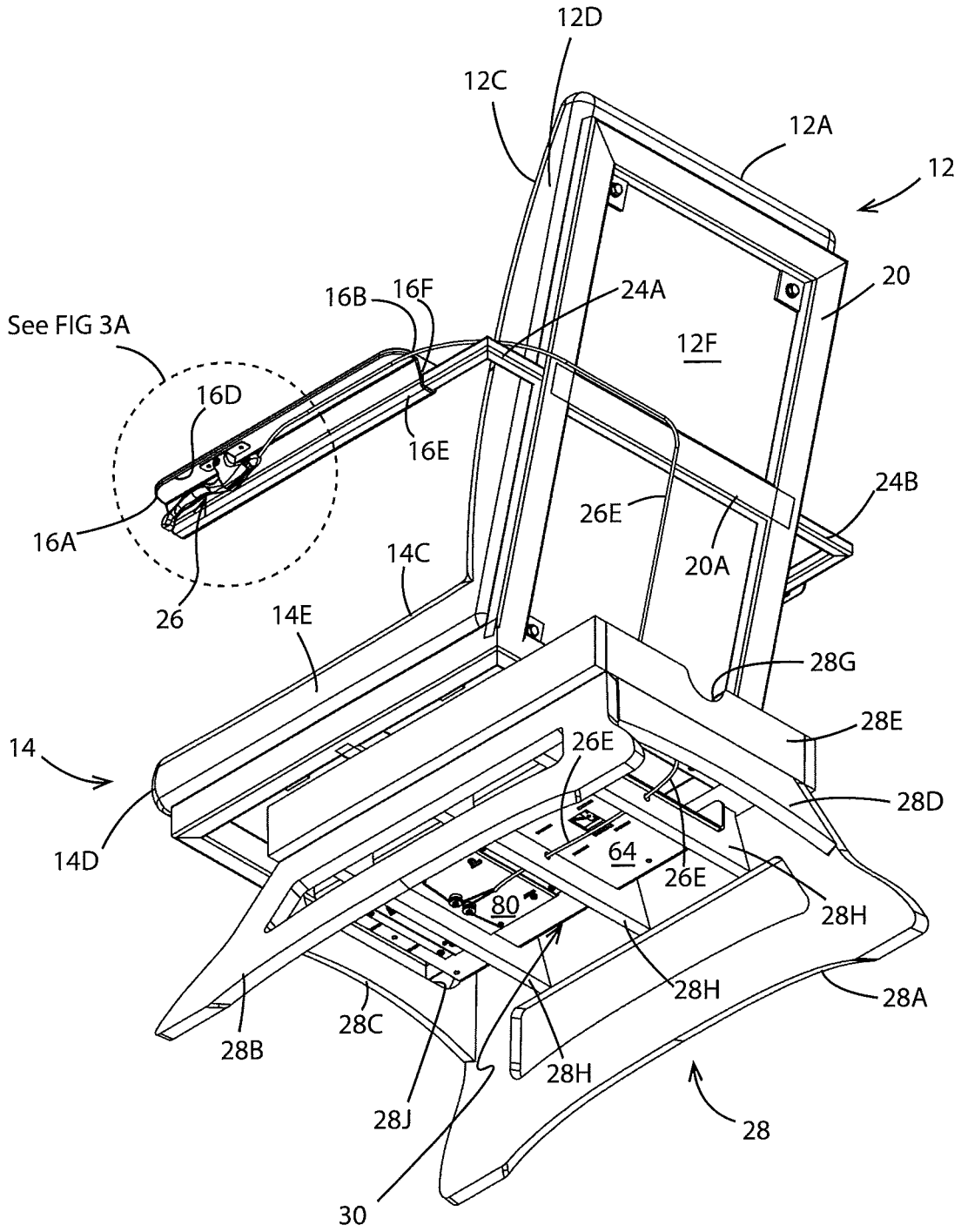
FIG. 3 (FIG. 3) is a bottom, back, right side perspective view of the exemplary chair.
Figure 3A:
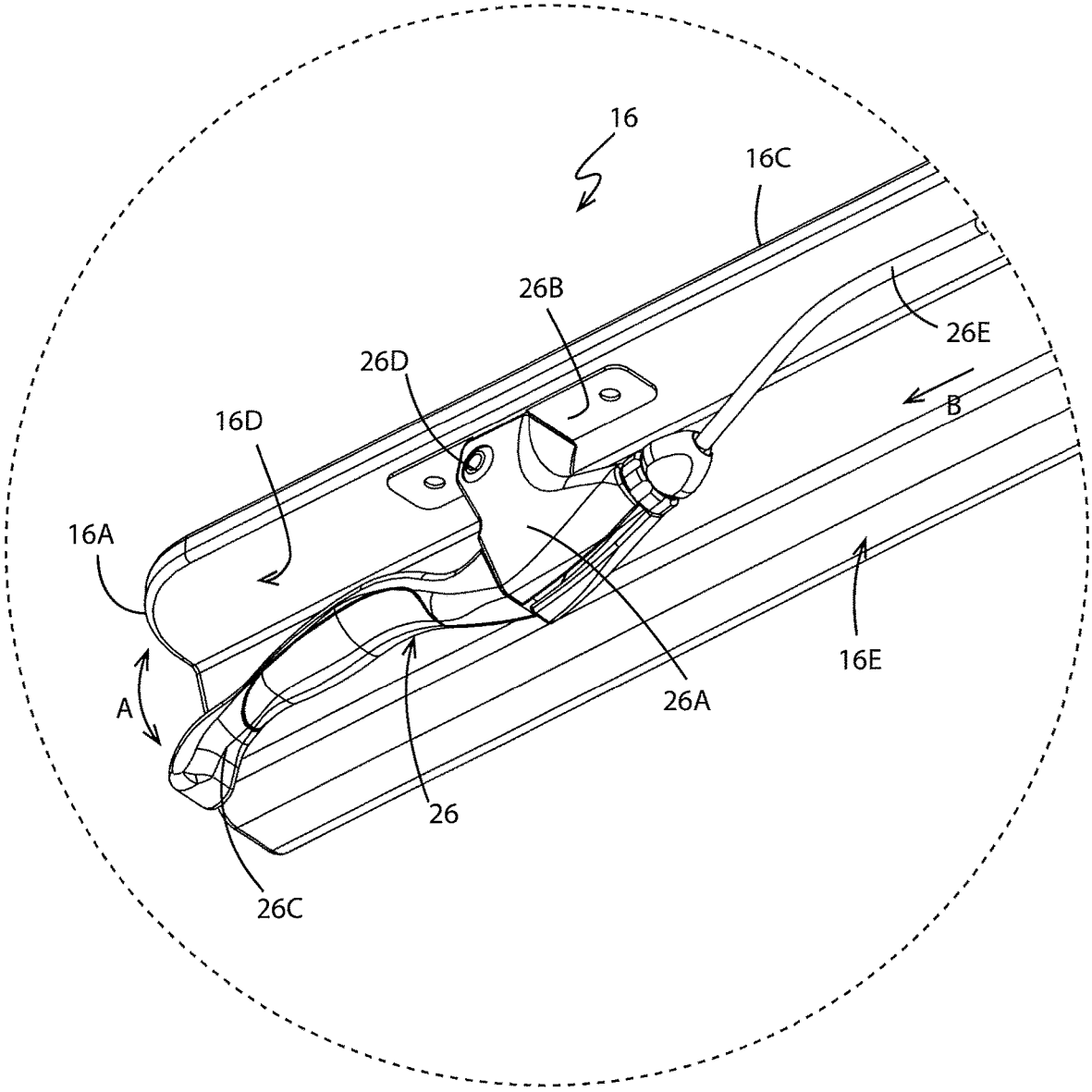
FIG. 3A (FIG. 3A) is an enlargement of the highlighted region of FIG. 3.

A new adjustable chair 10 and a method of operation thereof is discussed in the present disclosure and is depicted in FIGS. 1-28. Chair 10 is a new and improved apparatus that assists physically challenged individuals to get into and out of the chair when the chair is adjacent a horizontal surface that is approximately at chest height when seated, and to move towards and away from the horizontal surface while seated in the chair. The horizontal surface will be referred to herein as a table surface or a work surface but may be any surface that the individual needs to be able to move toward or away including surfaces such as a kitchen counter or a vanity.

Referring now to FIGS. 1-5, the exemplary chair 10 includes a back 12, a seat 14, a left side armrest 16, and a right side armrest 18, mounted onto a frame 20, 22. Back 12 may be generally rectangular in shape when chair 10 is viewed from the front. Back 12 includes a top 12A and a bottom 12B, with the bottom 12B being vertically spaced from the top 12A. The top 12A may be generally rectangular in shape when chair 10 is viewed from above. Top 12A may include various decorative beveled regions. The back 12 further includes a first side 12C and a second side 12D that extend between top 12A and bottom 12B with second side 12D being transversely spaced from the first side 12C. Back 12 further includes a front 12E and a back 12F that may both be generally rectangular in shape when viewed from in front of or behind chair 10, respectively. Front 12E may be convex in shape when chair 10 is viewed from the left side or right side. Front 12E and back 12F extend between the top 12A and bottom 12B, and between first side 12C and second side 12D. The back 12F is operatively engaged with a back frame 20 that supports the back 12 and holds it in a desired orientation. Although not illustrated herein, it will be understood that a finishing panel may be applied over back frame 20 so that the back frame 20 is not readily visible.

The bottom 12B of back 12 is adjacent to a rear end 14A of seat 14 and may be integral therewith or simply in abutting contact therewith. The seat 14 may be generally rectangular in shape when chair 10 is viewed from above. Seat 14 includes a front end 14B longitudinally spaced from the rear end 14A. A top surface 14C extends between rear end 14A and front end 14B. The front end 14B of seat terminates in a front face 14D which may be generally rectangular in shape when chair is viewed from the front. Seat 14 further includes a first side 14E and a second side 14F that is spaced transversely a distance away from first side 14E. Both the first side 14E and second side 14F may be generally rectangular in shape when chair 10 is viewed from the right side and left side respectively. Seat 14 further includes a bottom surface 14G that is attached to a seat frame portion 22. Bottom surface 14G is opposite top surface 14C and spaced a distance vertically away from top surface 14C. Seat frame portion 22 may be connected to back frame 20.

The first armrest 16 and the second armrest 18 are substantially identical in structure and function. Because of this similarity, only first armrest 16 will be described in detail herein. Differences between the first armrest 16 and second armrest 18 will be pointed out. First armrest 16 has a first end 16A and a second end 16B that are spaced a distance longitudinally apart from each other. A top 16C and a bottom 16D (FIG. 4) of first armrest 16 extend longitudinally between first end 16A and second end 16B. Top 16C and bottom 16D may be generally rectangular in shape. A U-shaped channel 16E (FIG. 4) extends downwardly from bottom 16D and runs from proximate first end 16A to second end 16D. First and second flanges 16F extend downwardly from first end 16A and second end 16B, respectively to at least partially close off access to a front opening and rear opening to channel 16E. The first and second flanges 16F may be generally trapezoidal in shape when chair 10 is viewed from the front or back. A cushioning pad 16G is provided on a portion of top 16C. First armrest 16 may further define a cup holder 16H that is shaped to receive a beverage cup therein.

Second end 16B of first armrest 16 is attached to the back frame 20 via an L-shaped bracket 24A that has a longitudinally-extending leg which is received through channel 16E of first armrest 16. A transverse leg of bracket 24A extends outwardly from the longitudinally-extending leg and connects to a portion of back frame 20, thereby securing first armrest 16 to back frame 20.

Second armrest 18 has a first end 18A and a second end 18B that are spaced a distance longitudinally apart from each other. A top 18C and a bottom 18D (FIG. 6) of second armrest 18 extend longitudinally between first end 18A and second end 18B. Top 18C and bottom 18D may be generally rectangular in shape. A U-shaped channel 18E (FIG. 6) extends downwardly from bottom 18D and runs from proximate first end 18A to proximate second end 18D. First and second flanges 18F extend downwardly from first end 18A and second end 18B, respectively, to at least partially close off access to a front opening and rear opening to channel 18E. The first and second flanges 18F may be generally trapezoidal in shape when chair 10 is viewed from the front or back. A cushioning pad 18G is provided on a portion of top 18C. While first armrest 16 is shown as defining a cup holder 16H therein, the cup holder may, instead be provided on second armrest 18. As illustrated in the attached figures, second armrest 18 does not define a cup holder therein.

Second end 18B of second armrest 18 is attached to the back frame 20 via an L-shaped bracket 24B that has a longitudinally-extending leg which is received through channel 18E of second armrest 18. A transverse leg of bracket 24B extends outwardly from the longitudinally-extending leg of bracket 24B and connects to a portion of back frame 20, thereby securing second armrest 18 to back frame 20. A cross-brace 20A (FIG. 2) may extend between the portions of brackets 24A and 24B that connect to back frame 20. The cross-brace 20*a*, as illustrated is a portion of back frame 20 but in other instances, the cross-brace may be an extension of the brackets 24A, 24B.

Chair 10 is provided with an actuator that is operative to activate a chair adjustment assembly which will be described later herein. In the illustrated embodiment, the actuator is identified by the reference character 26. Actuator 26 is operatively engaged with the sliding mechanism 26 and is movable between an actuated position where linear motion of the seat 14 relative to the base 28 is enabled, and a non-actuated position where linear motion of the seat 14 relative to the base 28 is prevented.

Actuator 26 includes a base 26A that is mounted via a flange 26B and fasteners (not shown) to the bottom 16D of first armrest 16. A trigger 26C is engaged with base 26A via a pivot rod 26D. Trigger 26C may be pivoted upwardly toward bottom 16D of first armrest 16 and will pivot downwardly away from bottom 16D when trigger 26C is released. The possible motion of trigger 26C is indicated by the arrow "A" in FIGS. 3A, 5A, 8, and 11. A first end of a cable 26E is operatively engaged with trigger 26C and is pulled in a direction indicated by arrow "B" toward base 26A when trigger 26C is squeezed toward bottom 16D. A second end of cable 26E is engaged with the adjustment assembly for the chair, as will be described later herein. Cable 26E moves in the opposite direction to arrow "B" when trigger 26C is released. It will be understood that actuator 26 may alternatively be mounted on second armrest 18 or that an actuator 26 may be mounted on each of first armrest 16 or second armrest 18 or at any other suitable location on chair 16. Additionally, the type of actuator may be different from the physical trigger mechanism disclosed herein. For example, an electronic actuator may be utilized that simply requires a button to be depressed or utilized any other form of activation and/or deactivation.

Figure 4:
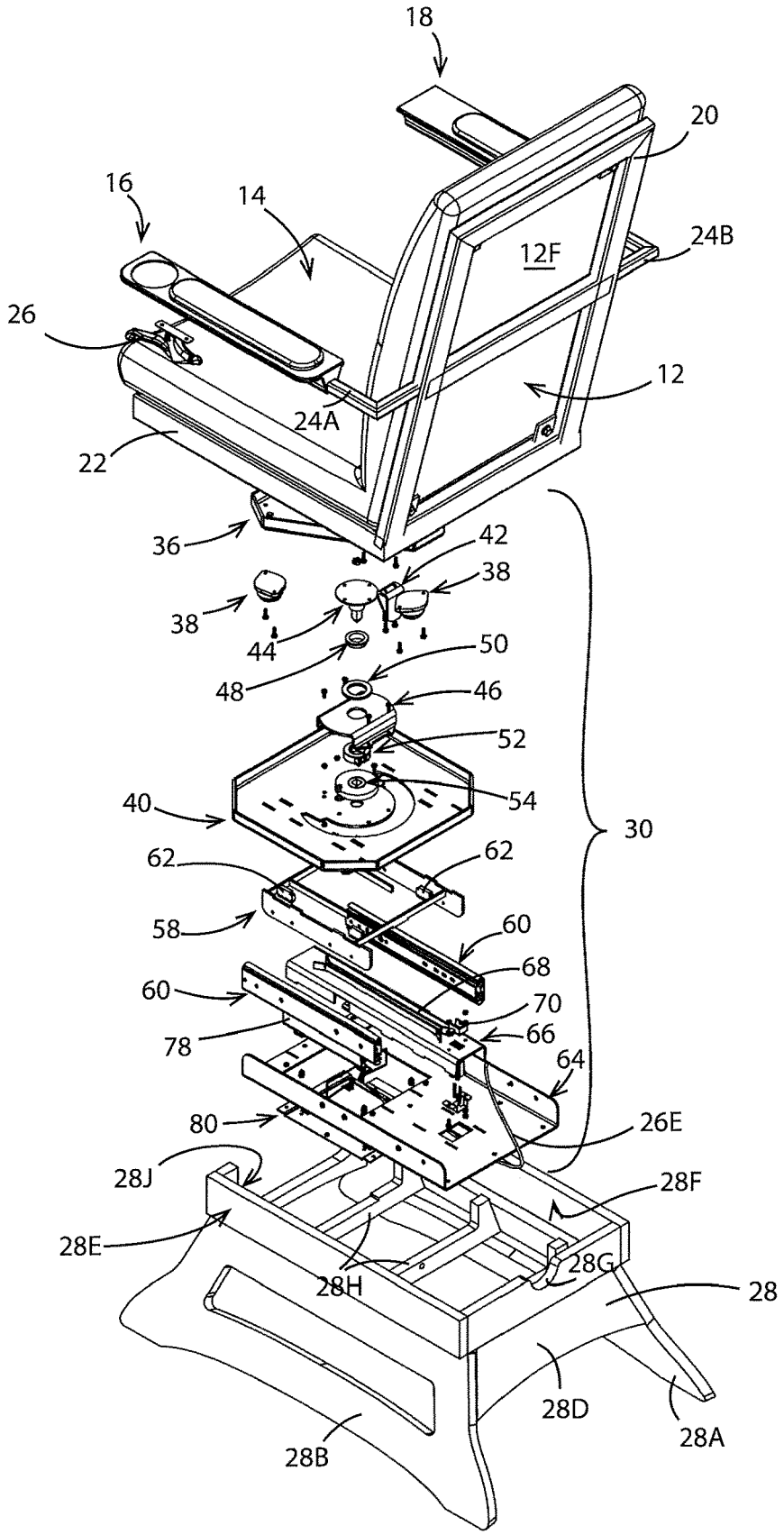
FIG. 4 (FIG. 4) is an exploded top, back, right side perspective view of the exemplary chair.
Figure 5:
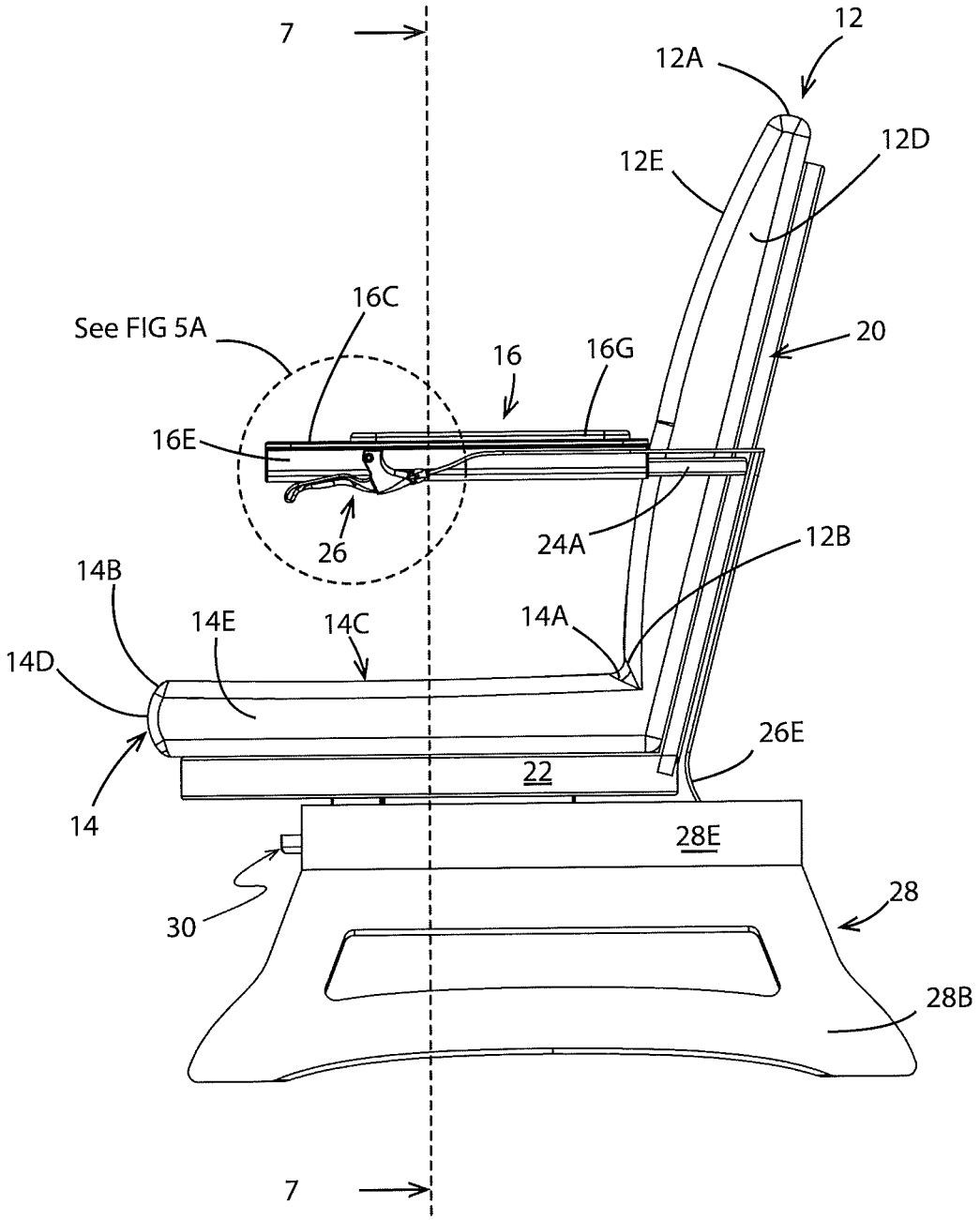
FIG. 5 (FIG. 5) is a right side elevation view of the exemplary chair shown in a forward and neutral position.
Figure 5A:
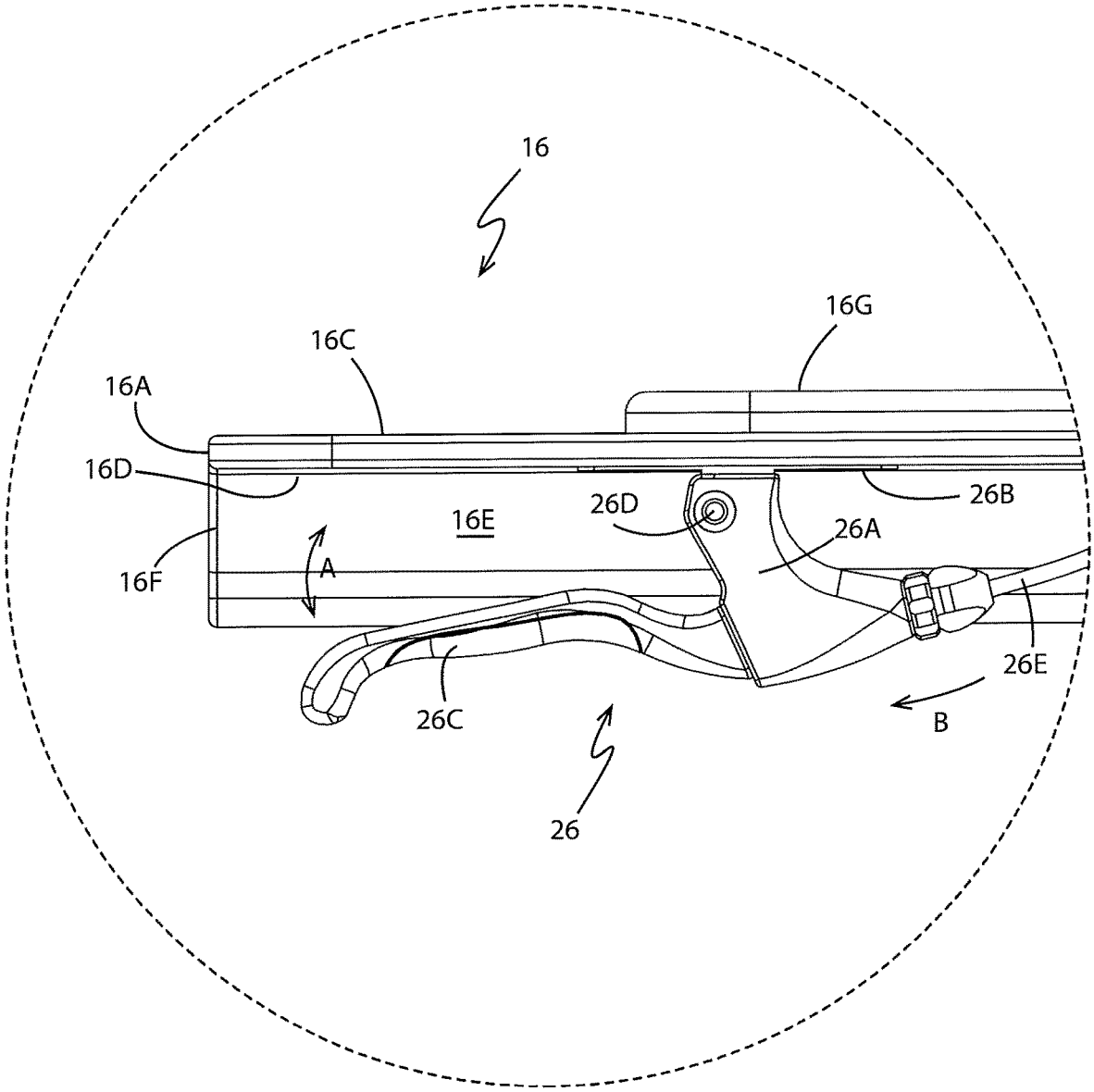
FIG. 5A (FIG. 5A) is an enlargement of the highlighted region of FIG. 5.

Chair 10 also includes a chair base 28. The chair base 28 supports the chair 10 and makes rests upon a flat surface. This surface may be any suitable surface such as a floor. Base 28 includes a first side 28A and a second side 28B that is spaced laterally from first side 28A. A front cross member 28C and a rear cross member 28D extend between first and second sides 28A, 28B. Additionally, an upper rim 28E connects first and second sides 28A, 28B and front and rear cross members 28C, 28D. Upper rim 28E bounds and defines an interior compartment 28F and at least a portion of the interior compartment 28F houses various components of a chair adjustment assembly 30 (FIG. 4) which will be discussed later herein. FIG. 4 also shows that a plurality of U-shaped ribs 28H extend between the interior surfaces of first and second sides 28A, 28B and these ribs 28H add strength and rigidity to base 28. It will be understood that additional strengthening members may form part of base 28. A portion of upper rim 28E above rear cross member 28D defines a notch 28G therein and through which a portion of the cable 26E of the actuator 26 extends. FIG. 4 also shows that upper rim 28E may not extend all the way above front cross member 28C and between first and second sides 28A, 28B. Instead, one or more openings 28J may be defined therein. The opening 28J is provided so that some components of an adjustment assembly 30 may periodically extend outwardly and forwardly beyond front cross member 28C as illustrated in FIG. 5.

As illustrated in the various figures, first and second sides 28A and 28B are shaped and oriented in such a way that the base 28 is generally wider at its bottom which contacts the surface than at its top which is proximate seat 14. Base 28 therefore tapers from bottom to top. The cross members 28C, 28D span transversely between the flared sides 28A, 28B. In one embodiment, the base contacts the surface at four points because of the configuration of first and second sides 28A, 28B. The configuration of base 28 gives chair 28 stability when the adjustment assembly 30 is actuated, as will be described hereafter.

Figure 4A:
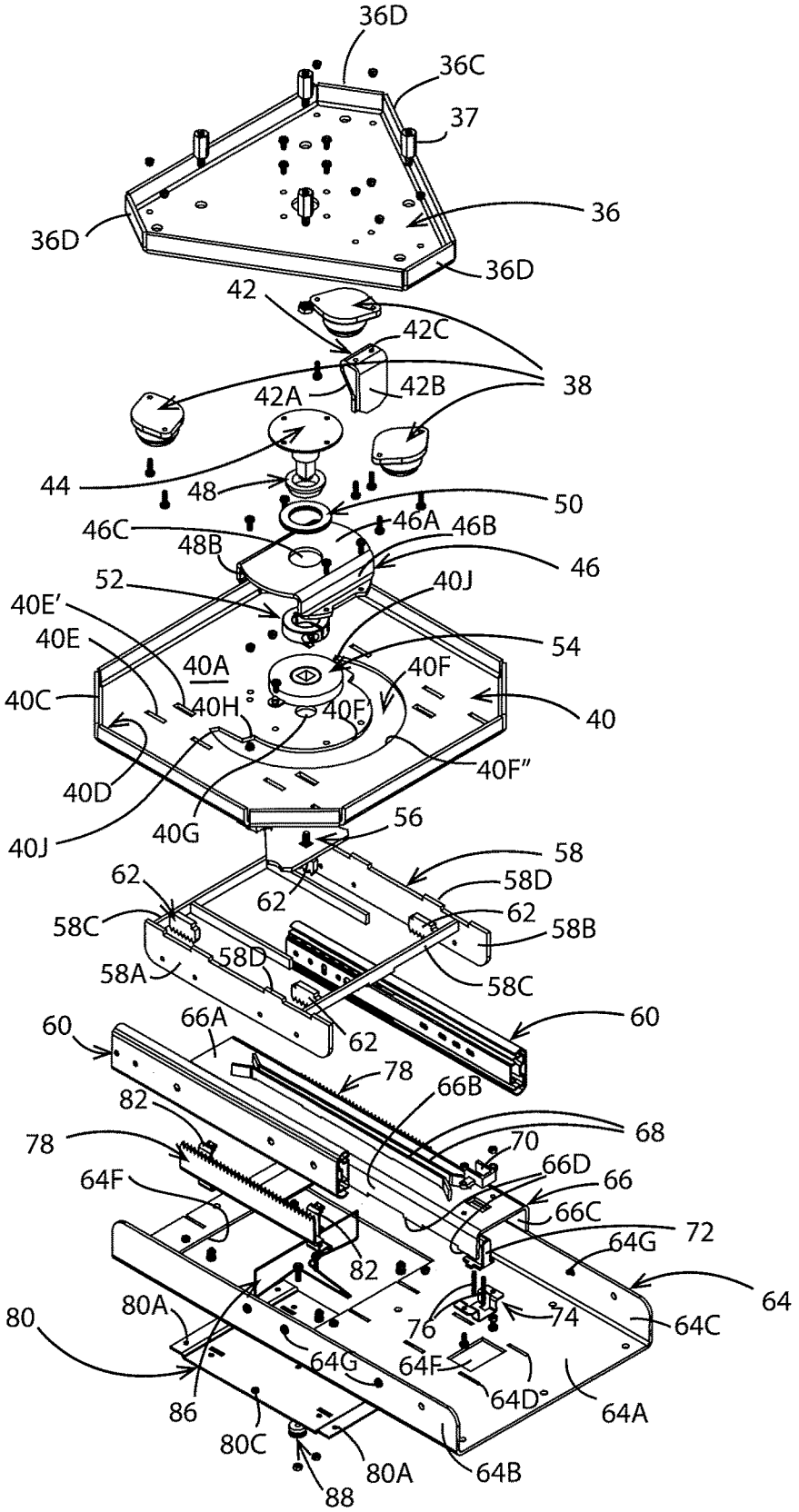
FIG. 4A (FIG. 4A) is an exploded top, back, right side perspective view of an adjustment assembly of the exemplary chair shown on its own; wherein the adjustment assembly includes a rotational mechanism and a sliding mechanism.
Figure 4B:
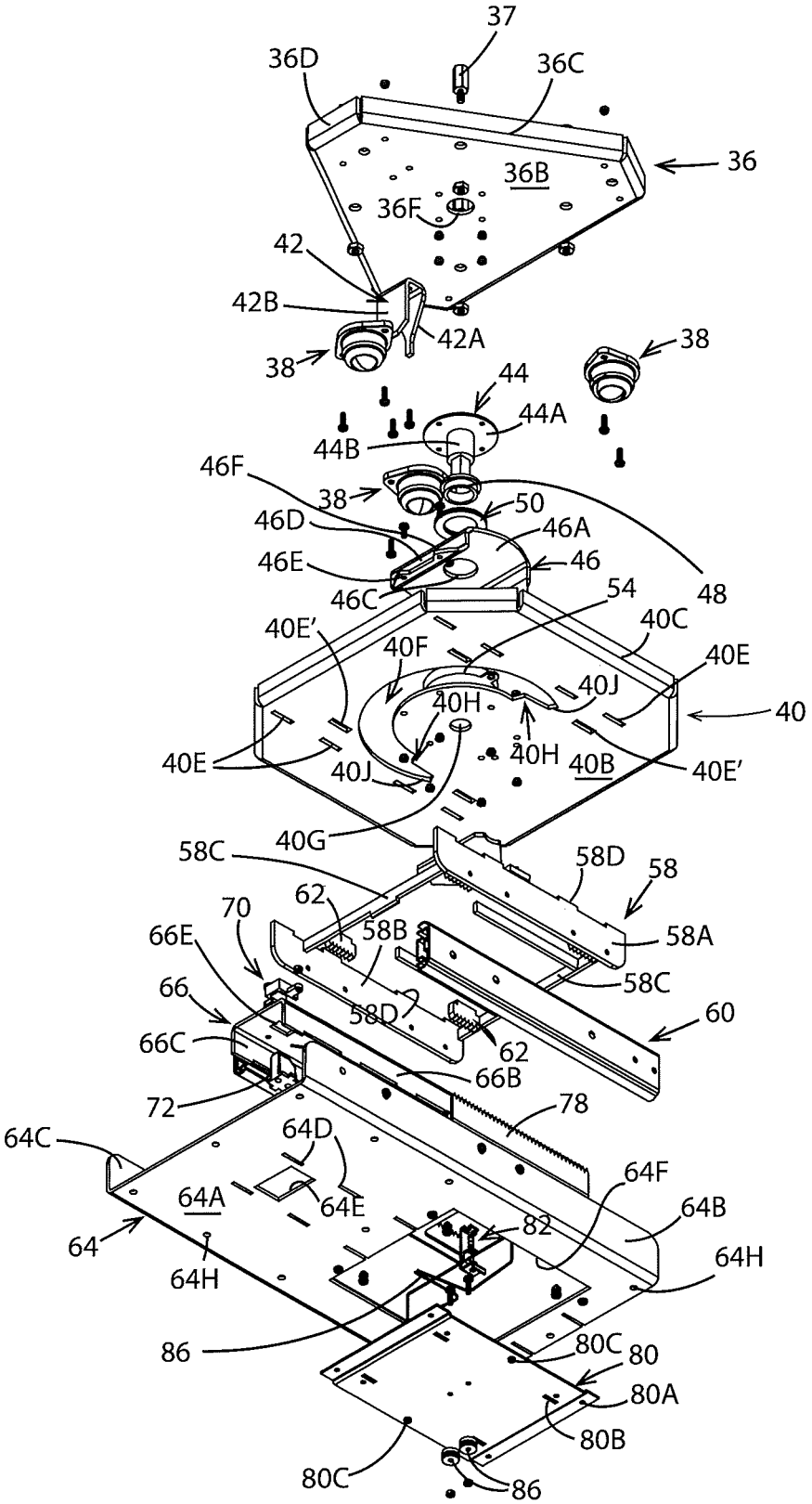
FIG. 4B (FIG. 4B) is an exploded bottom, front, right side perspective view of the adjustment assembly of FIG. 4 shown on its own.

Referring now to FIG. 4, FIG. 4A, and FIG. 4B, the adjustment assembly 30 for the chair 10 is illustrated. It will be understood that some components of adjustment assembly 30 illustrated in the figures, such as fasteners and washers, may not be numbered as discussed herein for the sake of brevity. Furthermore, components, such as various fasteners, may not be illustrated in the for the sake of clarity of illustration.

Figure 7:
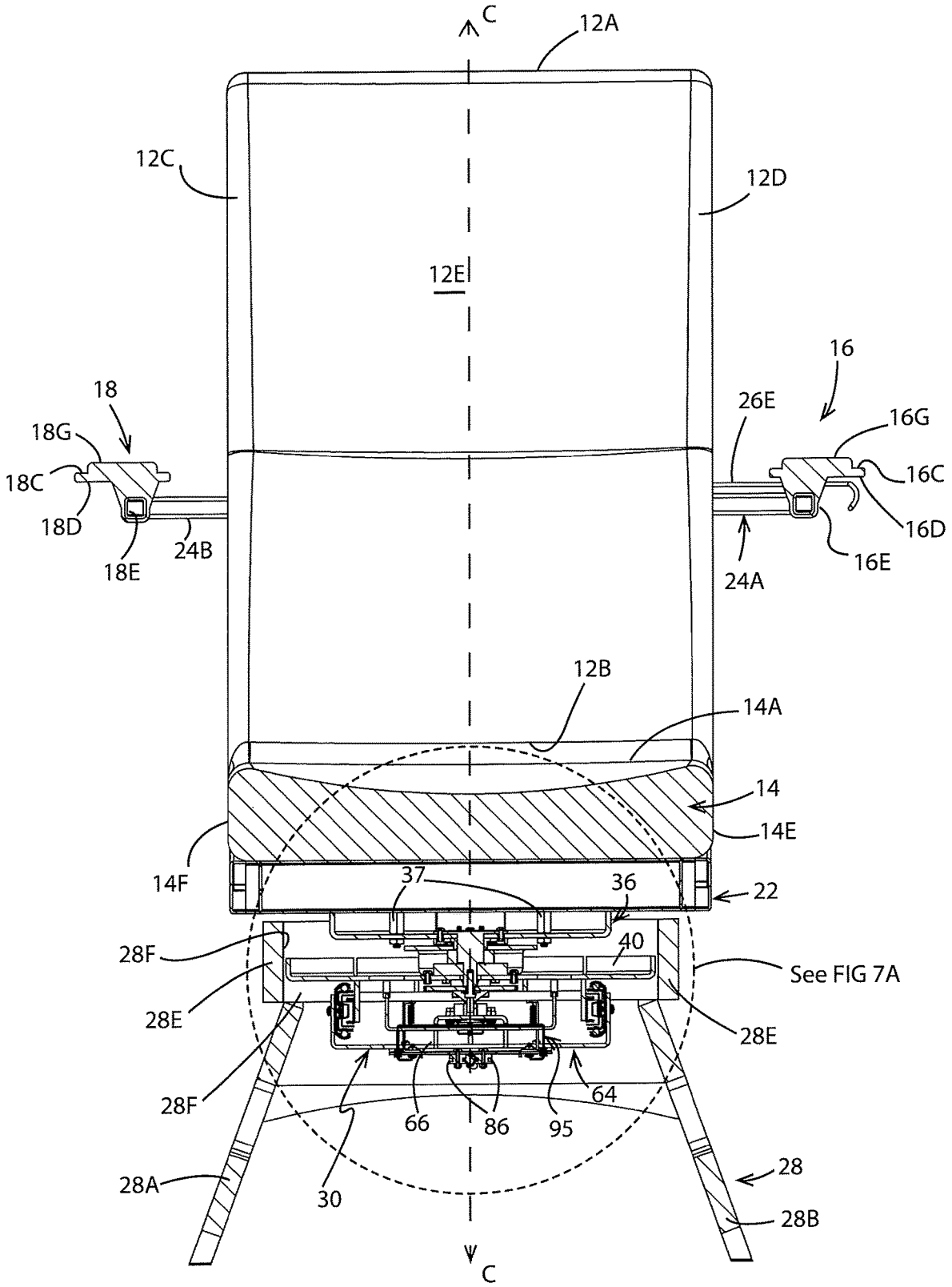
FIG. 7 (FIG. 7) is a lateral cross-section of the exemplary chair taken along the line 7-7 of FIG. 5.

Adjustment assembly 30 comprises a rotational mechanism 32 and linear mechanism/sliding mechanism 34. The terms "linear mechanism" and "sliding mechanism" may be used interchangeably herein. The rotational mechanism 32 and sliding mechanism 34 are selectively operatively engaged with each other as will be described later herein. Rotational mechanism 32 enables the seat 14 and back 12 to rotate in unison relative to base 28 about a vertical axis "C" (FIG. 7). The vertical axis "C" is located where a longitudinal axis "Y" (FIG. 8) of the chair 10 and a transverse axis "X" intersect. Sliding mechanism 34 enables the seat 14 and back 12 to slide back and forth in unison relative to base 28 and along a horizontal axis that is parallel to longitudinal axis "Y".

Figure 6A:
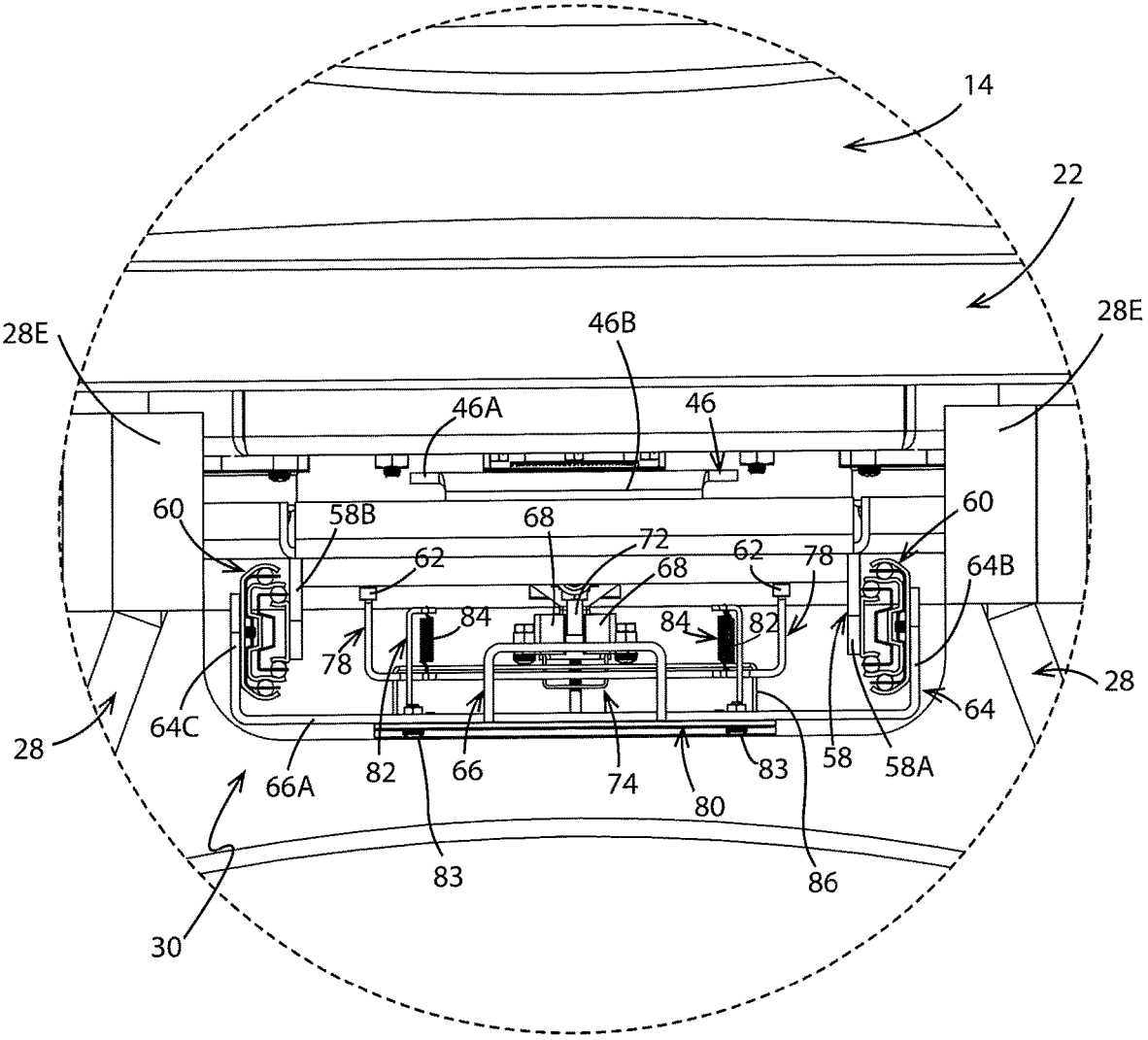
FIG. 6A (FIG. 6A) is an enlargement of the highlighted region of FIG. 6.
Figure 7A:
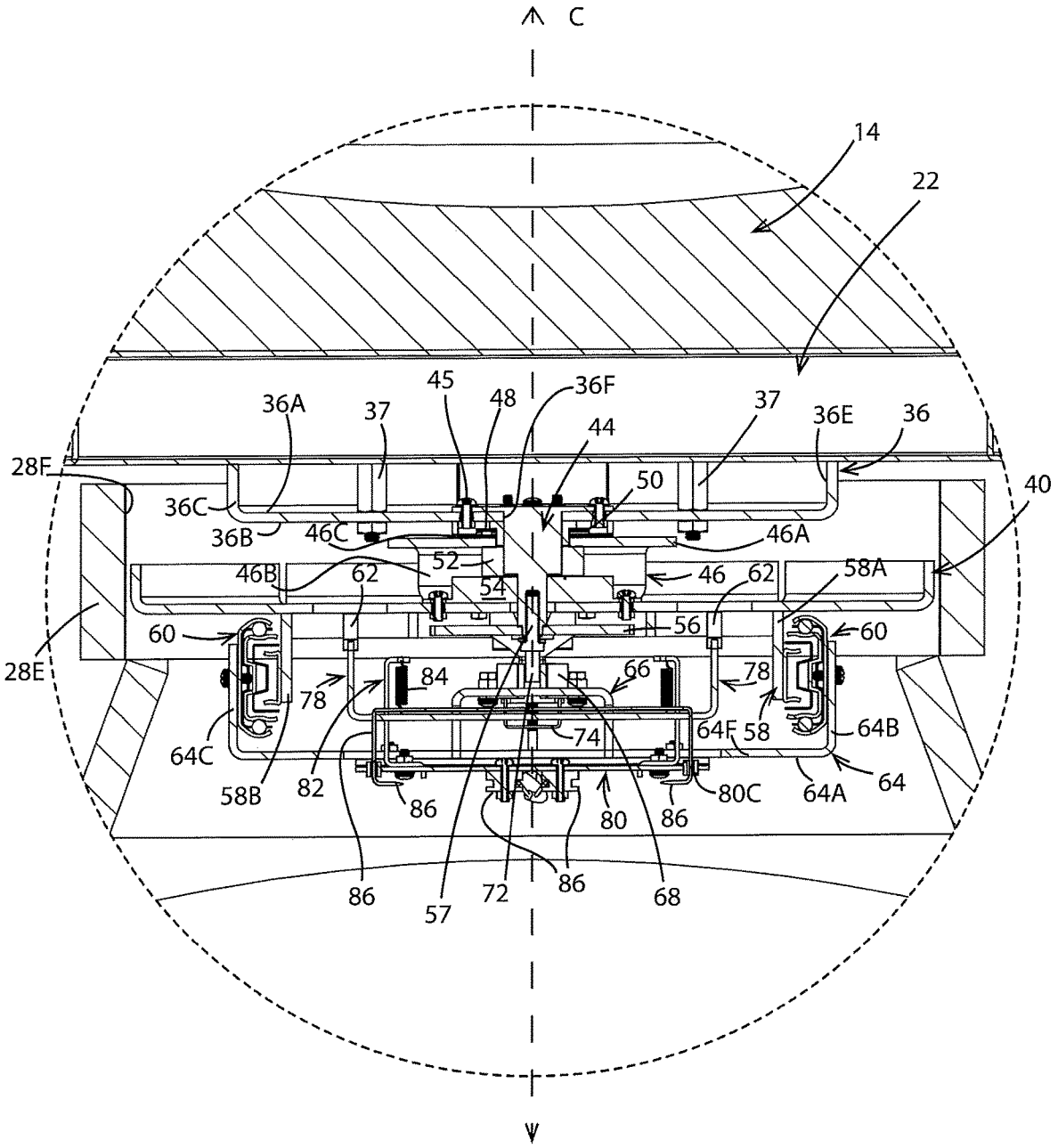
FIG. 7A (FIG. 7A) is an enlargement of the highlighted region of FIG. 7.
Figure 8:
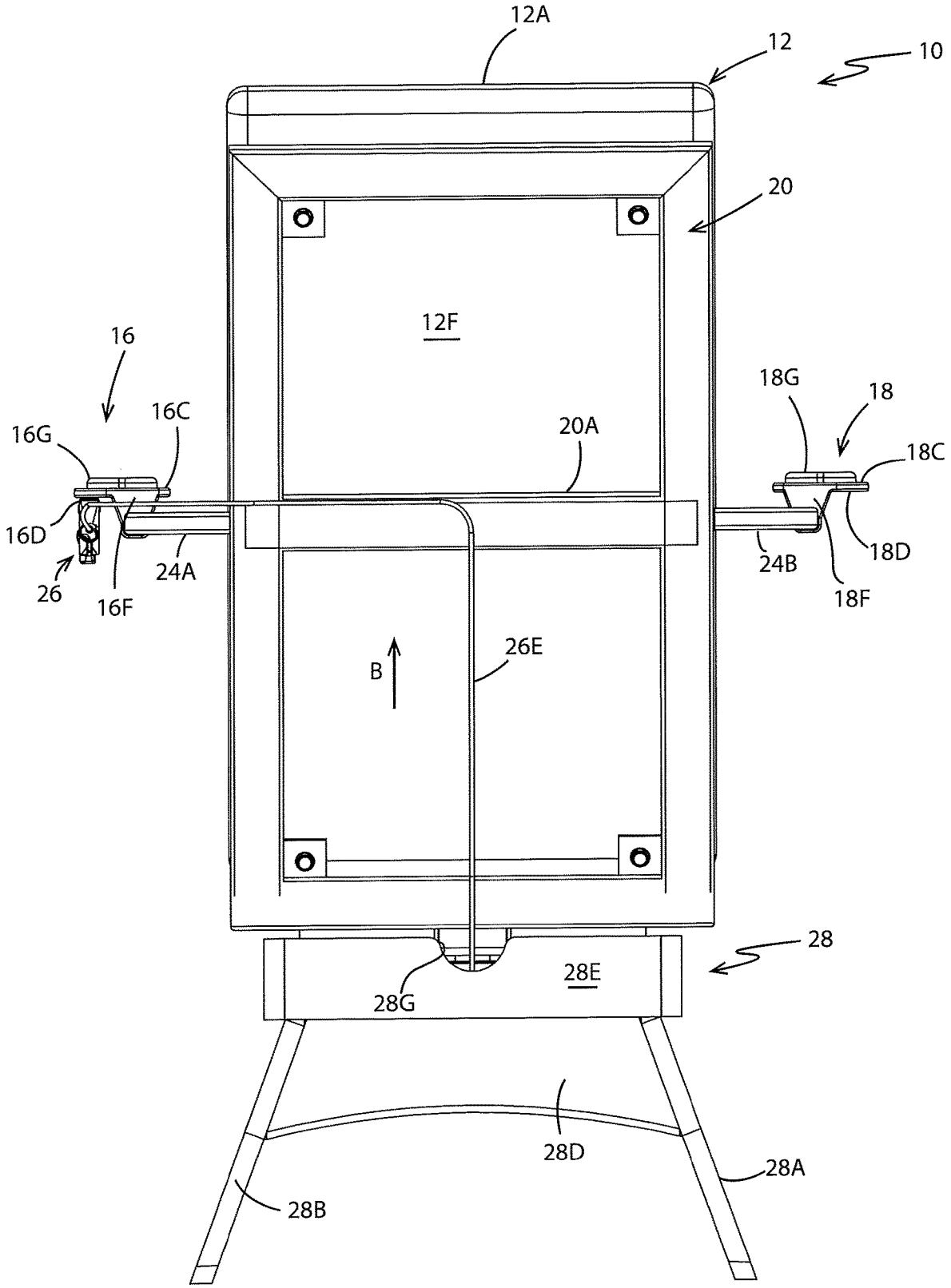
FIG. 8 (FIG. 8) is a rear elevational view of the exemplary chair.

As shown in FIGS. 4A and 4B, moving from top to bottom (with the top being proximate seat 14), rotational mechanism 32 includes a rotary bracket 36, a plurality of transfer balls 38, a roller plate 40, a stop 42, a pivot shaft 44 and a base cap plate 46. The rotary bracket 36, as illustrated, is generally triangular when viewed from above and includes a plate having a top surface 36A and a bottom surface 36B. A peripheral wall 36C extends upwardly beyond the top surface 36A (FIG. 7A) of the plate and has truncated apices 36D. The plate and peripheral wall 36C bound and define a chamber 36E (FIG. 6A). A plurality of fasteners 37 secure rotary bracket 36 to frame 22 of seat 14.

A plurality of openings is defined in the plate of rotary bracket 36, with the openings extending between top surface 36A and bottom surface 36B. The most significant of these openings is a central opening 36F (FIG. 4B), the purpose of which will be described later herein. The rotary bracket 36 is secured to seat frame 22 in such a way that the plate thereof is located a distance vertically below a bottom of seat frame 22 and with the chamber 36E of rotary bracket 36 being positioned between seat frame 22 and the top surface 36A of the plate.

FIGS. 4A and 4B show that the rotational mechanism 32 includes a plurality of transfer balls 38 engaged with rotary bracket 36. Each transfer ball 38 includes a flange 38A (FIG. 13) from which a housing 38B extends downwardly. Housing 38B defines a socket 38C within which a ball 38D is seated. The ball 38D is rotatable within the socket 38C. As illustrated, three transfer balls 38 are secured to rotary bracket 36 by engaging fasteners 39 through aligned apertures defined in the flange 38A of transfer ball 38 and the plate of rotary bracket 36.

Figure 6:
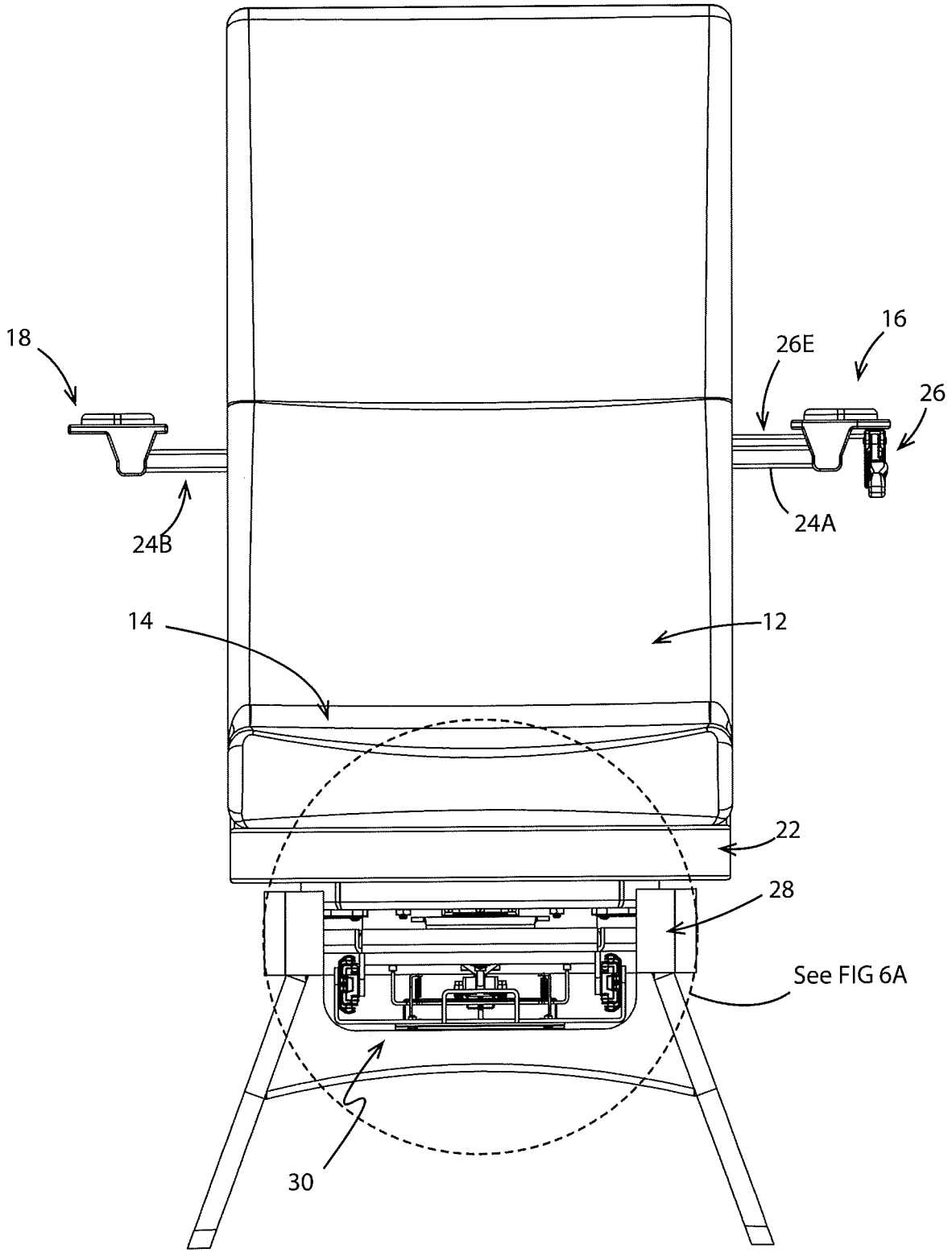
FIG. 6 (FIG. 6) is a front elevation view of the exemplary chair.

Rotational mechanism 32 further includes a roller plate 40 (FIGS. 4-4B and 6). Roller plate 40 has a top surface 40A, a bottom surface 40B and a peripheral wall 40C that extends upwardly beyond the top surface 40A. The top surface 40A and peripheral wall 40C bound and define a compartment 40D. The transfer balls 38 are positioned partially within compartment 40D and partially extend upwardly to bottom surface 38D of rotary bracket 38. The balls 38D ride along top surface 40A of roller plate 40.

Roller plate 40 defines a plurality of apertures therein that extend between top surface 40A and bottom surface 40B. In particular, roller plate 40 defines a plurality of slots 40E, 40E' that are spaced at intervals from each other and are aligned parallel to the longitudinal axis "Y" of chair 10. The slots are arranged in two outermost rows that include slots 40E and two innermost rows that include slots 40E'. The purpose of slots 40E, 40E' will be described later herein.

Roller plate 40 further defines a crescent-shaped aperture 40F and a central aperture 40G that each extend from top surface 40A through to bottom surface 40B. When assembled, central aperture 40G of roller plate 40 is vertically aligned along center axis "C". The crescent-shaped aperture 40F is defined by two spaced-apart arcuate surfaces 40F' and 40F". The outermost arcuate surface 40F" has a substantially constant radius of curvature along its length and is substantially smooth along its curve. The innermost arcuate surface 40F', on the other hand, defines a pair of spaced-apart shoulders 40H that extend inwardly into the crescent-shaped aperture 40F. Each shoulder 40H is located a relatively short distance inwardly from the associated adjacent apex 40J of the aperture 40F. The purpose of the shoulders 40H will be described later herein. When seat 14 is to be rotated relative to base 28, roller bracket 36 (which is fixedly secured to seat 14) is rotated relative to roller plate 40 as transfer balls 38 roll along the top surface 40A of roller plate 40.

Figure 10:
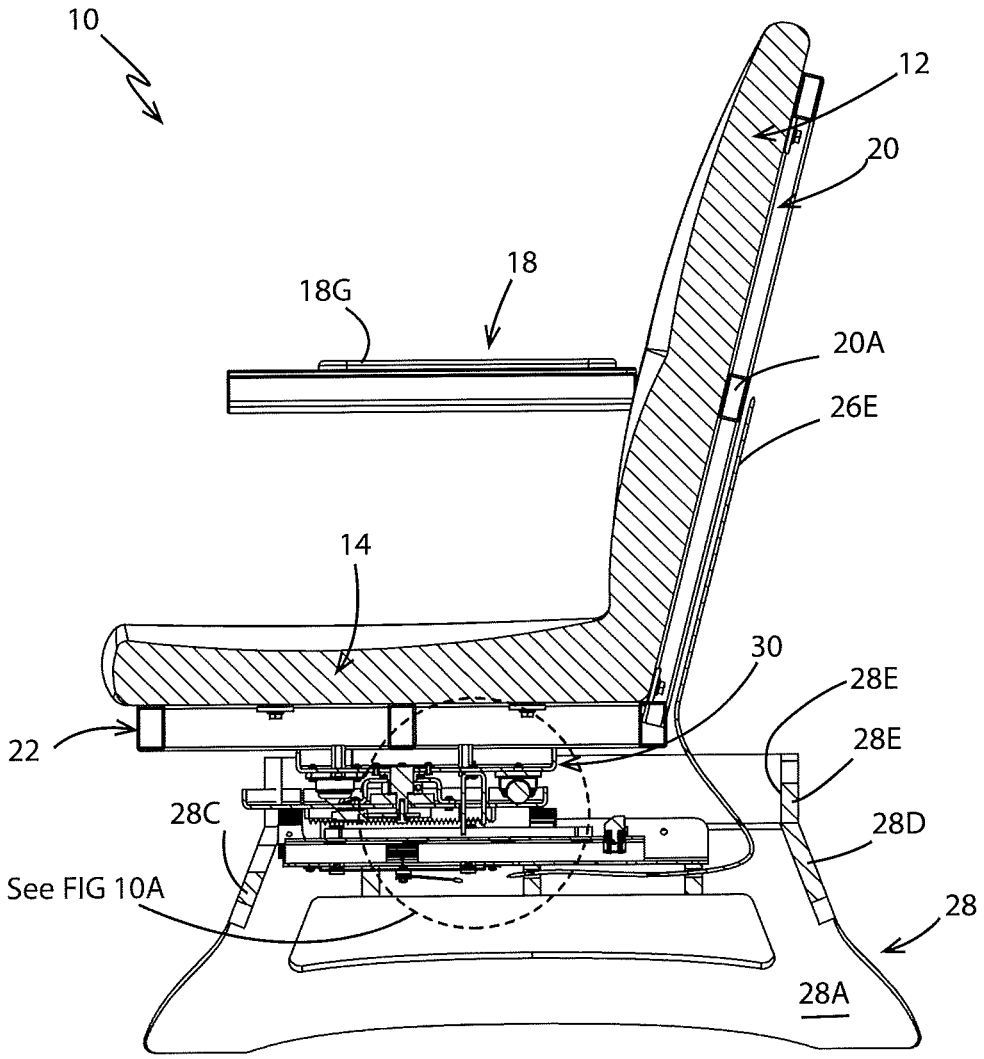
FIG. 10 (FIG. 10) is a longitudinal cross-section of the exemplary chair taken along line 10-10 of FIG. 9.
Figure 10A:
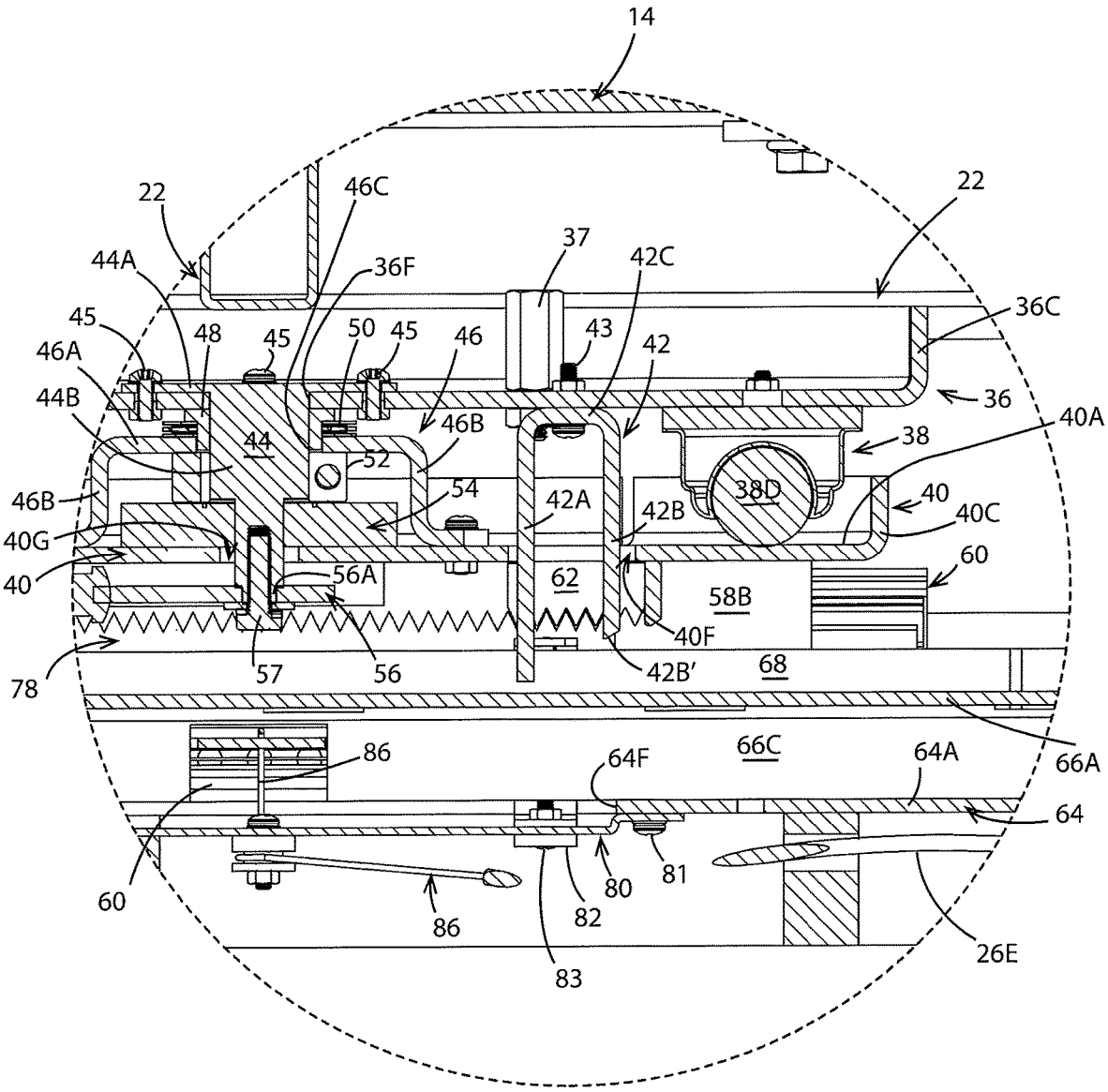
FIG. 10A (FIG. 10A) is an enlargement of the highlighted region of FIG. 10.
Figure 13:
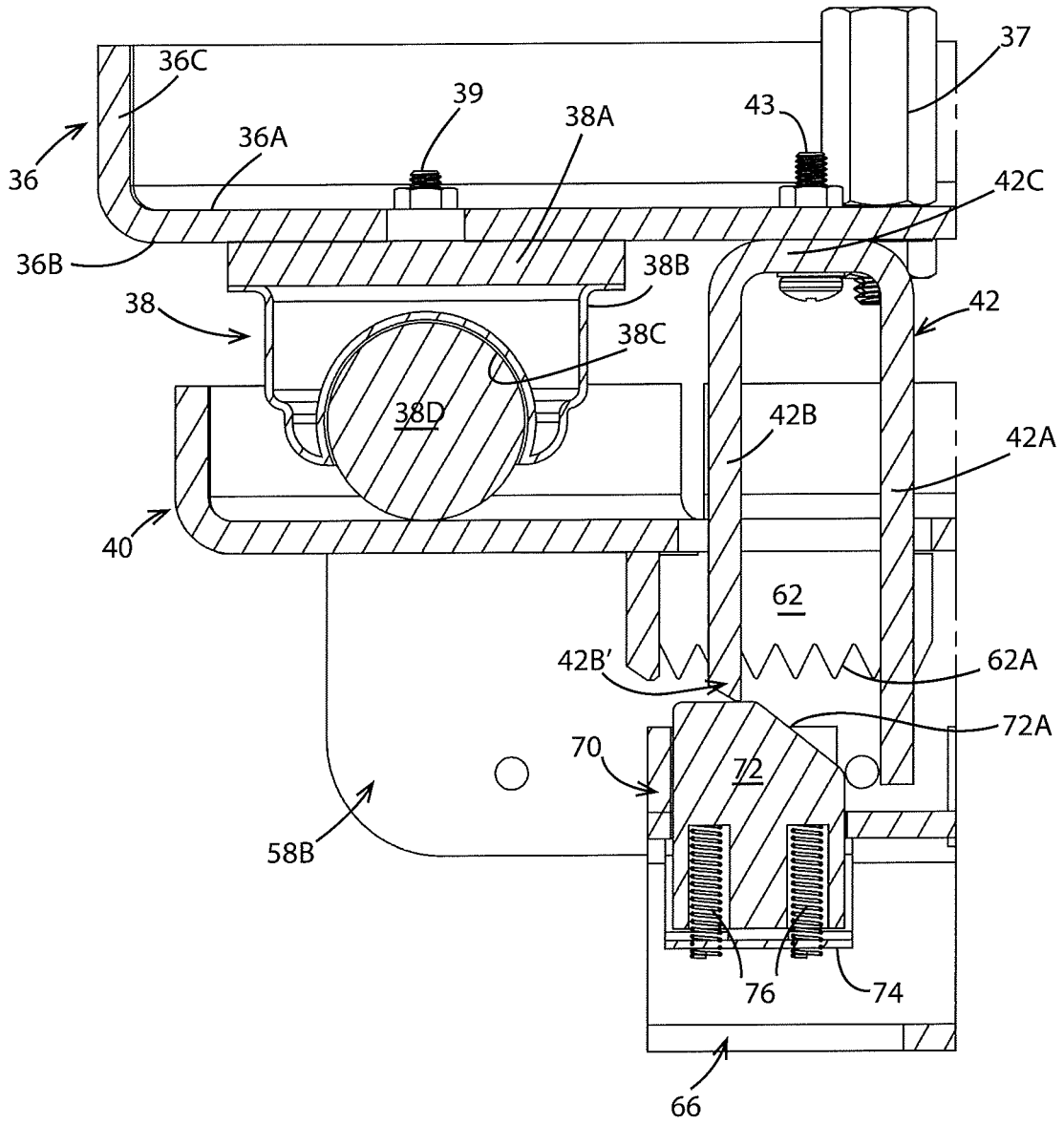
FIG. 13 (FIG. 13) is a cross-section of the rotational mechanism taken along line 13-13 of FIG. 12.

Referring to FIGS. 4-4B, 10A, and 13, the stop 42 of rotational mechanism 32 is secured to rotary bracket 36 by one or more fasteners 43. The purpose of stop 42 is to limit the extent to which roller bracket 36 (and thereby seat 14) will rotate relative to roller plate 40 and to selectively link the rotational mechanism 32 to the sliding mechanism 34. When secured to rotary bracket 36, stop 42 extends downwardly from bottom surface 36B and towards roller plate 40. Stop 42 may be a type of spring clip and, as is shown in FIGS. 10A and 13, includes a first arm 42A and a second arm 42B that extend outwardly in generally the same direction from a base 42C. First arm 42A is longer than second arm 42B and is differently shaped (FIGS. 4A and 4B). In particular, first arm 42A tapers to form a narrow tip (visible particularly in FIG. 4B) and this narrow tip is configured to ride along the innermost arcuate surface 40F' of crescent-shaped aperture 40F of roller plate 40 as roller bracket 38 rotates. Second arm 42B tapers to a generally U-shaped region (shown particularly in FIG. 20) that is wider than the tip of first arm 42A. As best seen in FIG. 13, a bottom end 42B' of second arm 42B includes a plurality of facets, "F1", "F2, and "F3". Each facet is inclined at an angle that is complementary to an angled face on a lock plunger that forms part of the sliding mechanism 34 and will be discussed later herein. The second arm 42B is configured to ride along the outermost arcuate surface 40F" of crescent-shaped aperture 40F of roller plate 40 as roller bracket 38 rotates relative to roller plate 40. The bottom end 42B' of second leg 42 of stop 42 is configured to contact the lock plunger of the sliding mechanism 34 when seat 14 and thereby stop 42 is in certain orientations and is figured to break contact with the lock plunger when the seat 14 and thereby the stop 42 are in other orientations.

The engagement of first arm 42A with one of the shoulders 40H defined by roller plate 40 tends to slow down or stop the rotation of roller bracket 38. The crescent shape of aperture 40F as it narrows towards the ends 40J (FIG. 4A), tends to cause first arm 42A to deflect inwardly toward second arm 42B. The reactionary outward force of first arm 42A in response to being deflected inwardly, particularly as first arm 42A moves past shoulder 40H, tends to generate friction and this friction tends to resist rotation of roller bracket 38 in either of a clockwise or counterclockwise direction. This frictional resistance has to be overcome if seat 14 is to be rotated. The combination of the engagement of first arm 42A with one of the shoulders 40H, along with the friction described above, will therefore tend to temporarily hold the seat 14 in place. This feature permits a person to rotate the seat 14 to a desired position and then either sit down on seat 14 or stand up from seat 14 without having the chair tend to rotate accidentally beneath them. This locking resistance makes it easier for someone with motion limitations to sit down in chair 10 or get up from chair 10.

With continued reference to FIGS. 4-4B and 10A, pivot shaft 44 of rotational mechanism 32 includes a flange 44A that may be generally circular in shape and a shaft 44B that extends outwardly from flange 44A. (The shaft 44B may include a region of greater diameter proximate flange 44A and a region of lesser diameter remote from flange 44A.) Pivot shaft 44 is engaged with rotary bracket 36 in such a way that flange 44A rests on top surface 36A of rotary bracket 36 and shaft 44B extends downwardly through central opening 36F. Fasteners 45 (FIG. 10A) secure flange 44A to rotary bracket 36.

Referring to FIGS. 4A, 4B, 10A, and 20, a base cap plate 46 is interposed between rotary bracket 36 and roller plate 40. The base cap plate 46 is generally U-shaped when viewed from one side and, as best seen in FIG. 10A includes a central member 46A and two downwardly extending legs 46B. A central aperture 46C is defined in central member 46A and this central aperture 46C is aligned with central aperture 36F in rotary bracket 36 and with central aperture 40G of roller plate 40. A bushing 48 and roller bearing 50 are positioned between flange 44A and an upper surface of central member 46A. A roller bearing 52 and rotary damper 54 are positioned between a bottom surface of central member 46A and the top surface 40A of roller plate 40. The shaft 44B of pivot shaft 44 extends downwardly from rotary bracket 36, passes through aligned apertures defined in bushing 48, roller bearing 50, central aperture 46C of base cap plate 46, roller bearing 52, rotary damper 54, and the central aperture 40G of roller plate 40. Fasteners 47 secure base cap plate 46 to roller plate 40. Rotary damper 54 is utilized to enable controlled deceleration of rotational motion of seat 14 relative to base 28 so that the motion of seat 14 is more easily controlled.

Rotational mechanism 30 further includes a connector plate 56 (FIG. 4A) that is positioned beneath the bottom surface 40B of roller plate 40. An aperture 56A (FIG. 10A) is defined therethrough. The shaft 44B exits the central aperture 40G of roller plate 40 and is received through the aperture 56A of connector plate 56. A fastener 57) locks shaft 44B in place. Rotary bracket 36 is thus able to rotate about the vertical axis "C" that extends along shaft 44B and relative to roller plate 40. Roller plate 40 remains in a fixed orientation while rotary bracket 36 and the seat affixed thereto rotates in either of a first direction or a second direction as will later be described herein.

Figure 9:
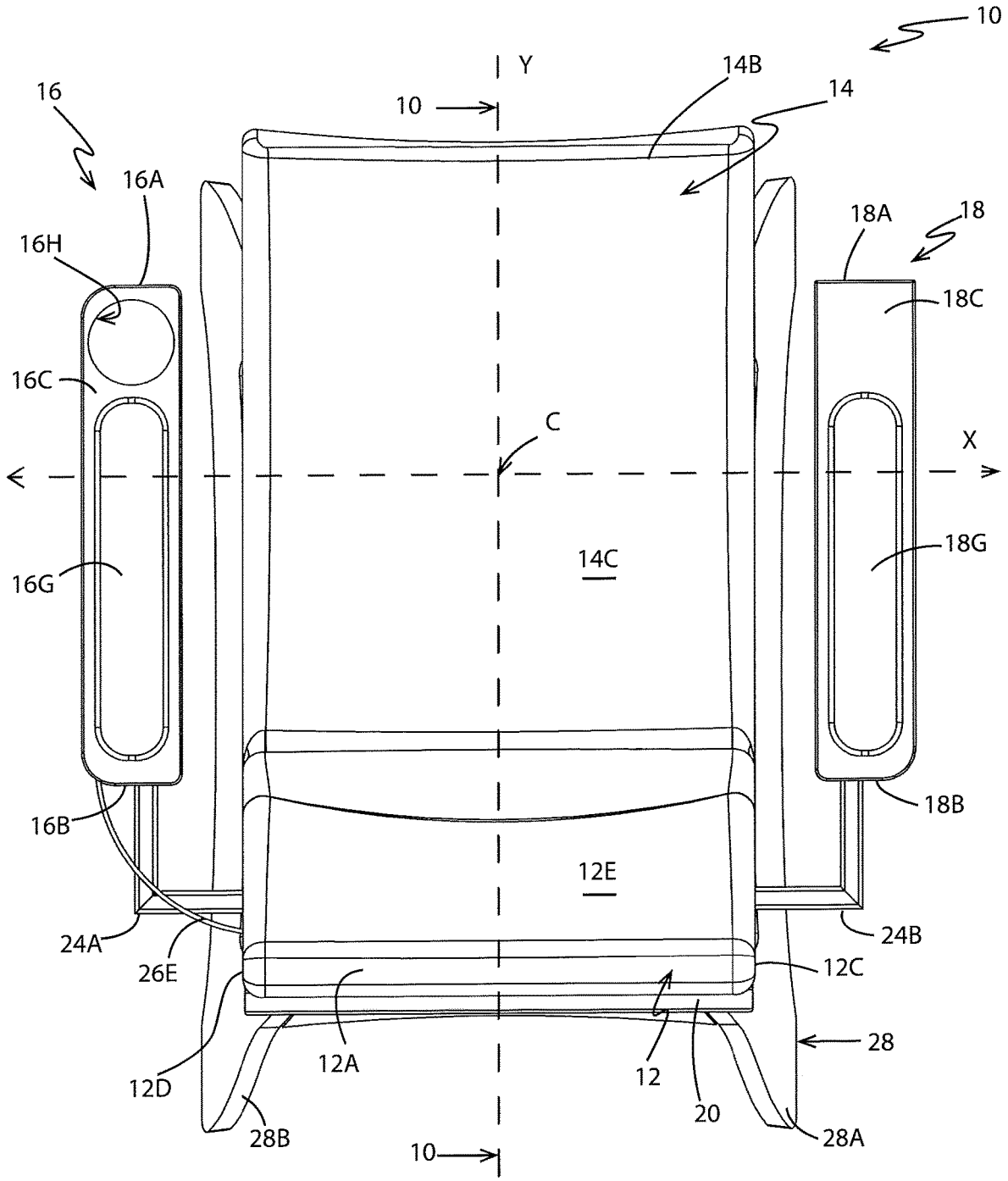
FIG. 9 (FIG. 9) is a top plan view of the exemplary chair.

As best seen in FIG. 4A, base cap plate 46 includes a generally U-shaped depression 46D that is defined in a lower edge of one of the legs 46B. V-shaped detents 46E, 46F extend outwardly away from the lower edge of the leg 46B on either side of depression 46D. The depression 46D is configured to receive a portion of stop 42 therein and comprises a first region of the rotational mechanism where rotational motion of seat 14 is slowed down or temporarily stopped. The first region comprises a neutral position for the rotational mechanism. When rotary bracket 36 is in the neutral position (i.e., non-rotated) and the seat 14 is facing forwardly (as shown in FIGS. 1 and 9), then stop 42 is seated within depression 46D. In this neutral position, the sides 14E, 14F of seat 14 are aligned with the first and second sides 28B, 28A of base 28, respectively.

If it is desired to rotate seat 14 so that sides 14E, 14F of seat 14 are at right angles to first and second sides 28B, 28A, it is necessary for stop 42 to move past one or the other of detents 46E, 46F. In particular, if seat 14 is to be rotated in a first direction, stop 42 must move past detent 46E; if seat 14 is to be rotated in a second direction, stop 42 must move past detent 46F. The first and second detents 46E, 46F extend into the crescent-shaped aperture 40F and form obstructions past which the stop 42 must travel during rotational motion. Because of the shape of these detents 46E, 46F, and their location relative to aperture 40F, the detents will tend to slow down rotational motion of seat 14. Furthermore, because of the shape of the detents, a person seated in the chair or a caregiver of the person seated in the chair must apply some initial force to move the chair out of the neutral position. In order for stop 42 to move past either detent 46E, 46F, first leg 42A of stop 42 must be moved inwardly toward second leg 42B. As the person seated in chair 10 (or the caregiver holding onto chair 10) applies force to rotate seat 14 in one of the first direction and the second direction, the first leg 42A rides along the V-shape of the associated detent 46E, 46F and progressively deflects inwardly toward second leg 42B. The deflection ceases and the first leg 42A returns to its original position as soon as the apex of the V-shaped detent 46E or 46F is passed. The seat 14 is freely able to rotate until one of the shoulders 40H is encountered.

Figure 12:
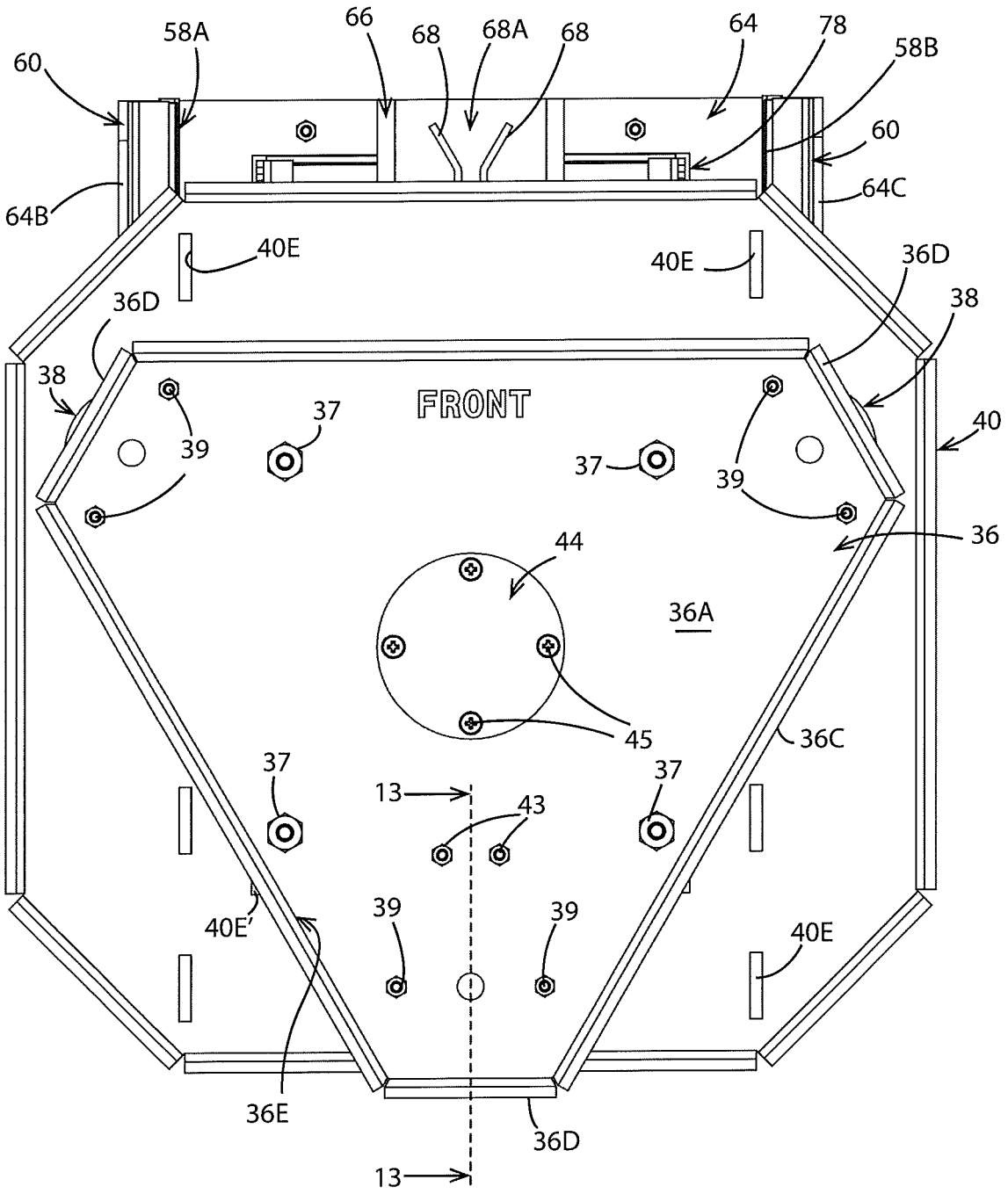
FIG. 12 (FIG. 12) is a top plan view of the adjustment assembly shown on its own with the rotational mechanism thereof illustrated in a neutral position and with the sliding mechanism thereof in a rearward position.

The detents 46E, 46F, and depression 46D therefore provide a first locking mechanism for holding seat 14 in the neutral position (FIG. 12). A first one of the two shoulders 40H on roller plate 40, along with the associated narrowing of the adjacent crescent-shaped aperture 40F to a first tip 40J, provide a second locking mechanism that holds the seat 14 in a first angled position. A second one of the two shoulders 40H, along with the associated narrowing of the adjacent crescent-shaped aperture 40F to a second tip 40J, provide a third locking mechanism that holds the seat 14 in a second angled position. The first and second angled positions may be at 90° relative to the neutral position (and the longitudinal axis "Y") and therefore at 180° relative to each other. Alternatively, it will be understood that the first and second angled positions may be oriented at other angles relative to the neutral position and/or to each other. The positioning of the chair 10 in the neutral position, first angled position, and second angled position will be discussed further later herein.

As indicated earlier herein, the adjustment assembly 30 provided on chair 10 includes the rotary mechanism 32 described above and a sliding mechanism 34 that will be described hereafter. The sliding mechanism 34 enables the seat 14 to slide linearly relative to the base 28. In particular, the sliding mechanism 34 enables the seat 14 to slide forwardly and rearwardly in a direction parallel to the longitudinal axis "Y" of chair 10.

Referring to FIGS. 4A and 4B, s64aliding mechanism 34 includes a rail mount assembly 58, one or more slider rails 60, and a plurality of locking members 62. Rail mount assembly 58 comprises a first side 58A and a second side 58B that are spaced laterally apart from each other and are oriented parallel to each other and to longitudinal axis "Y" of chair 10. Crossbars 58C extend between first side 58A and second side 58B and are secured thereto. Each of the first side 58A and second side 58B includes a plurality of bosses 58D extending upwardly from an upper surface thereof. Bosses 58D are shaped and sized so as to be individually received within one of the slots 40E defined in roller plate 40. The engagement of bosses 58D in slots 40E fixedly secures rail mount assembly 58 to roller plate 40. Each of the first and second sides 58A, 58B is configured to be interlockingly engaged with one of the two slider rails 60. The slider rails 60 are able to slide longitudinally inwardly and outwardly relative to the first and second sides 58A, 58B in much the same manner as a drawer is able to slide in and out of a cabinet.

As illustrated in FIGS. 4A and 4B, four locking members 62 are provided on sliding mechanism 34, however fewer than four locking members 62 or more than four locking members 62 may be utilized. Each locking member 62 comprises a body having an upper surface and a lower surface. A detent extends upwardly from the upper surface thereof and is configured to be complementary in shape and size to one of the slots 40E' of roller plate 40. When the detent on locking member 62 is received in one of the slots 40E', locking member 62 is secured to roller plate 40. Each locking member 62 includes a plurality of teeth 62A (FIG. 13) that are provided on the lower surface thereof opposite the detent. The purpose of teeth 62A will be described later herein.

Figure 25:
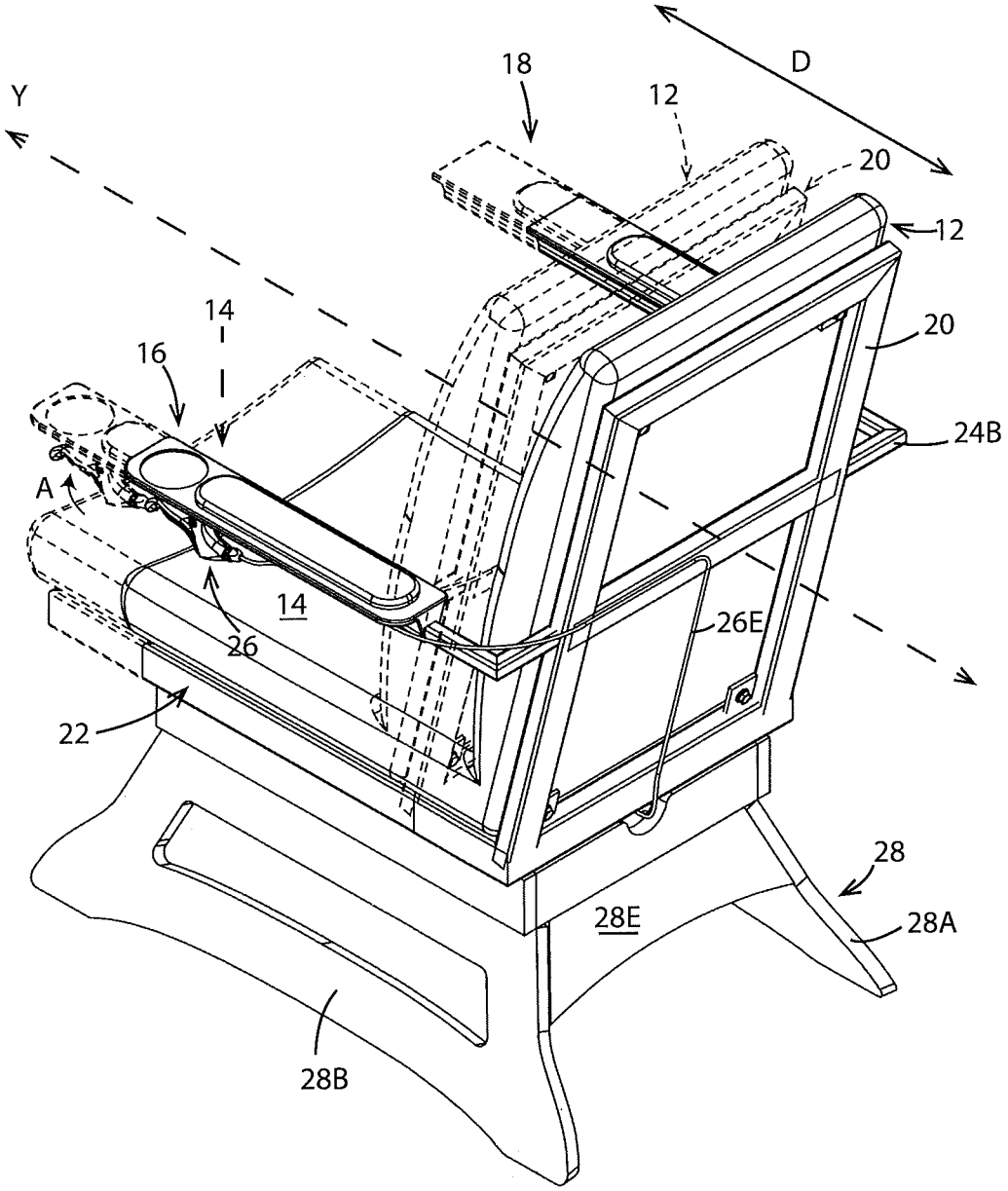
FIG. 25 (FIG. 25) is a top, back, right side perspective view of the exemplary chair moving between a first linear position and a second linear position.
Figure 26:
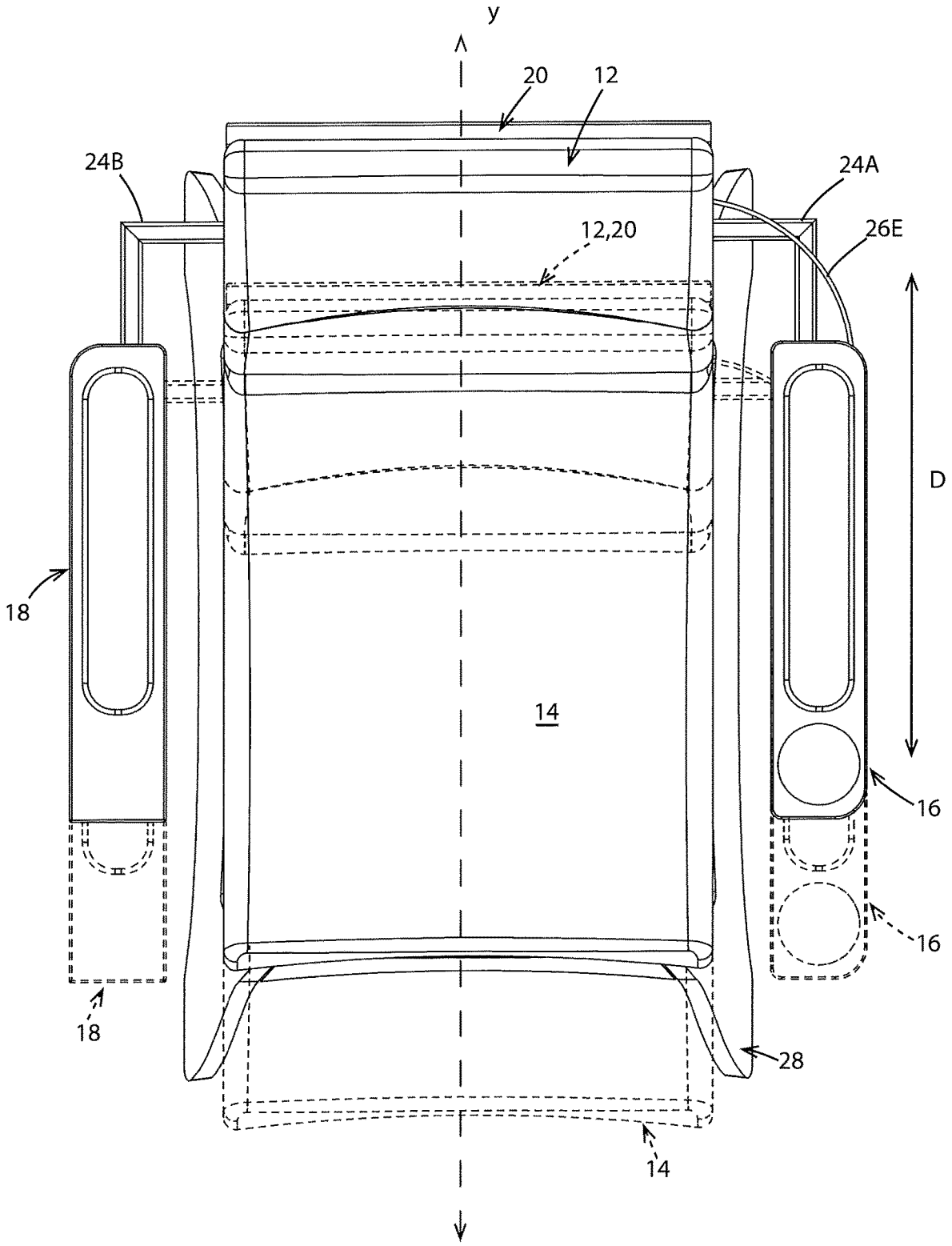
FIG. 26 (FIG. 26) is a top plan view of the exemplary chair of FIG. 25 moving between the first linear position and the second linear position.
Figure 27:
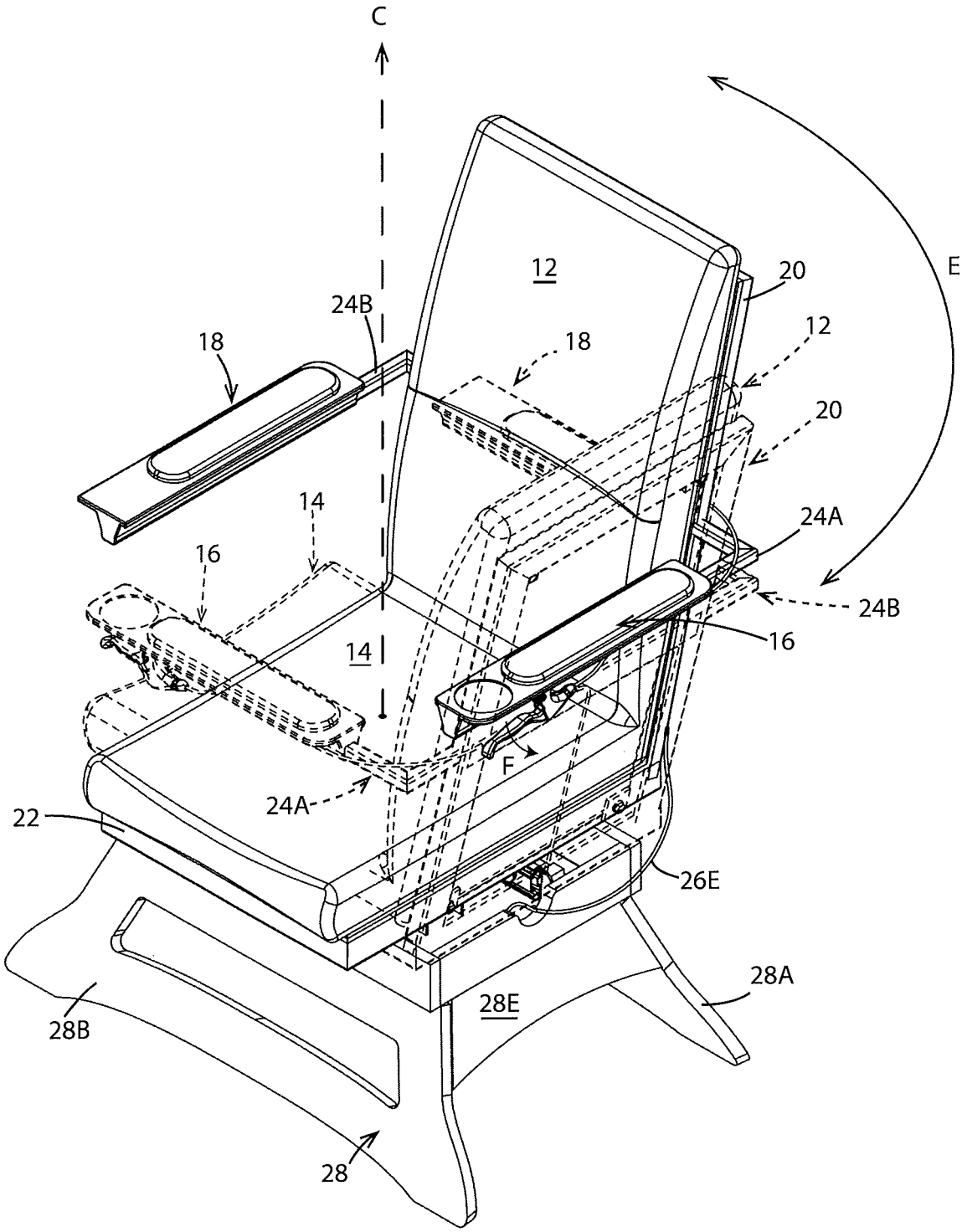
FIG. 27 (FIG. 27) is a top, front, right side perspective view of the exemplary chair moving between a first rotational position and a second rotational position.
Figure 28:
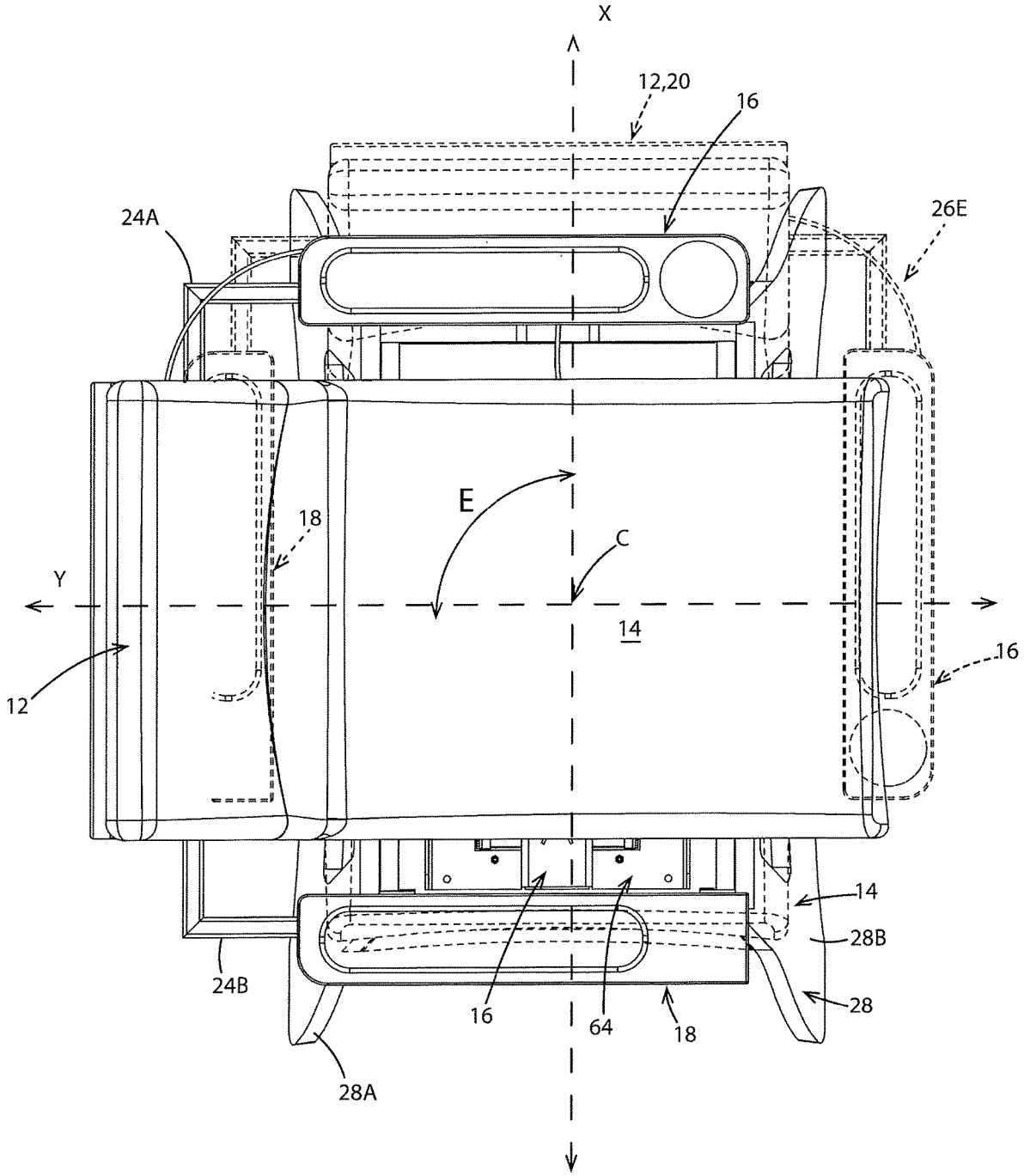
FIG. 28 (FIG. 28) is a top plan view of the exemplary chair of FIG. 27 moving between the first rotational position and the second rotational position.

Sliding mechanism 34 further includes a U-shaped base frame 64 including a central region 64A (FIGS. 4A and 4B) and first and second side members 64B, 64C. A plurality of longitudinally-extending slots 64D is defined between an upper and lower surface of central region 64A. Central region 64A also defines a first opening 64E and a second opening 64F, where the second opening 64*f* is substantially larger than the first opening 64E. A number of through-holes 64G are defined in first and second side members 64B, 64C and a number of through-hoes 64H are defined in central region 64A. Fasteners (not shown) are inserted through the through-holes 64G and into aligned apertures defined in ribs 28H of base 28. Base frame 64 is therefore a stationary component that is fixedly secured to base 28 and will remain in a fixed orientation and position regardless of whether the seat 14 is being rotated or being moved linearly relative to base 28. Linear motion of seat 14 (and back 12) relative to base 28 is indicated in FIGS. 25 and 26 as sliding linear motion in either of a first direction or a second direction that is parallel to longitudinal axis "Y" and indicated by arrow "D". Rotational motion of seat 14 (and back 12) relative to base 28 is indicated in FIGS. 27 and 28 as rotational motion in either of a first direction or second direction about the vertical axis "C" and is indicated by the arrow "E".

Figure 20:
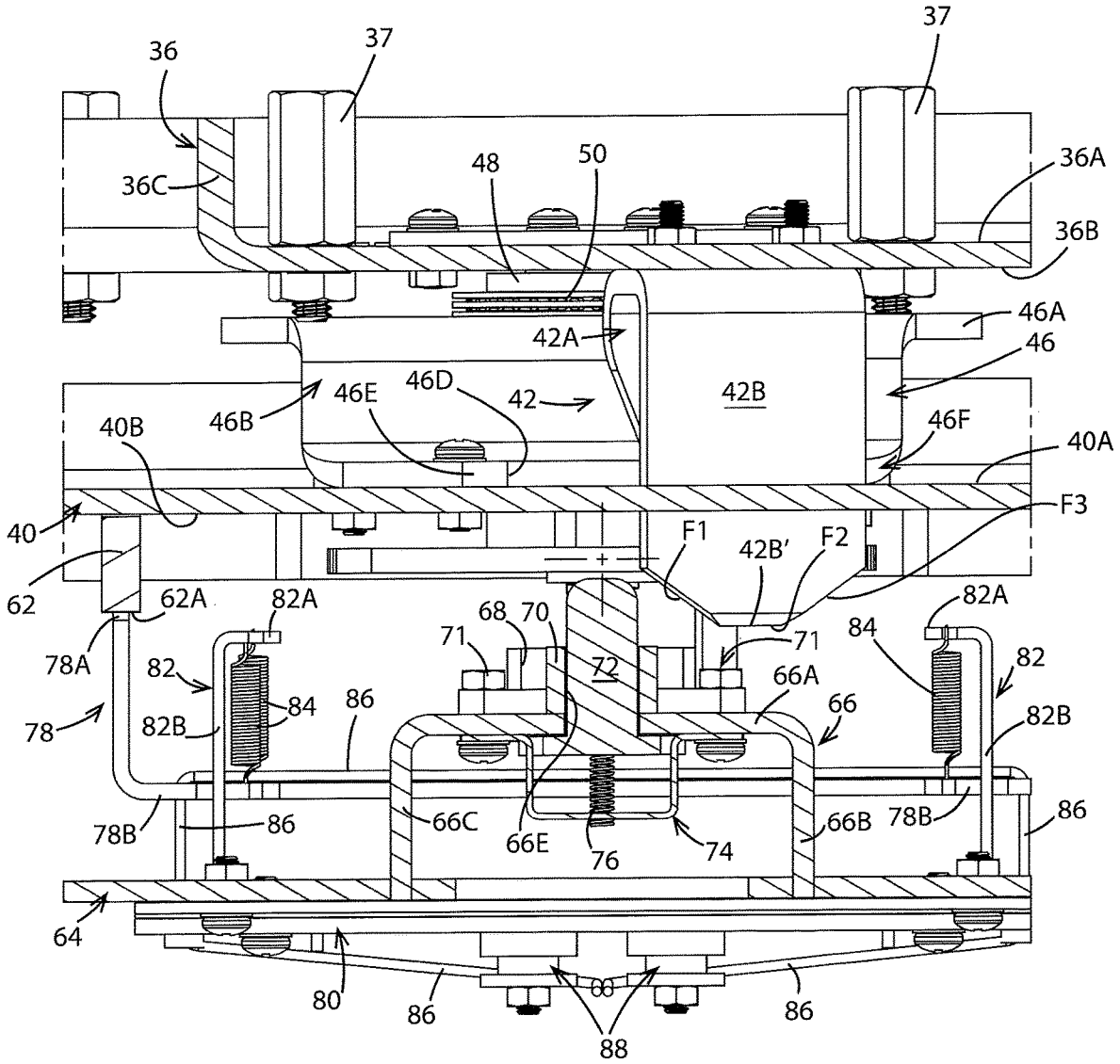
FIG. 20 (FIG. 20) is a cross-section taken along line 20-20 of FIG. 19.

Referring to FIGS. 4-4B and 20, an inverted U-shaped rail support 66 forms part of sliding mechanism 34. Rail support 66 has a central region 66A with first and second side members 66B, 66C extending downwardly therefrom in generally the same direction. A lower surface of each of the first and second side members 66B, 66C defines a plurality of detents 66D (FIG. 4A) therein that are spaced longitudinally apart from each other. The detents 66D are complementary to the location, size, and shape of at least some of the slots 64D defined in base frame 64. The detents 66D are received in slots 64D to secure rail support 66 to base frame 64. Rail support 66 is therefore fixedly engaged with base 28 via base frame 64 and therefore will remain stationary regardless of whether the seat 14 is being rotated or moved linearly. Central region 66A of rail support 66 defines an opening 66E (FIGS. 4B and 20) that is located a short distance inwardly from one end thereof. The purpose of opening 66E will be described later herein.

Figure 16:
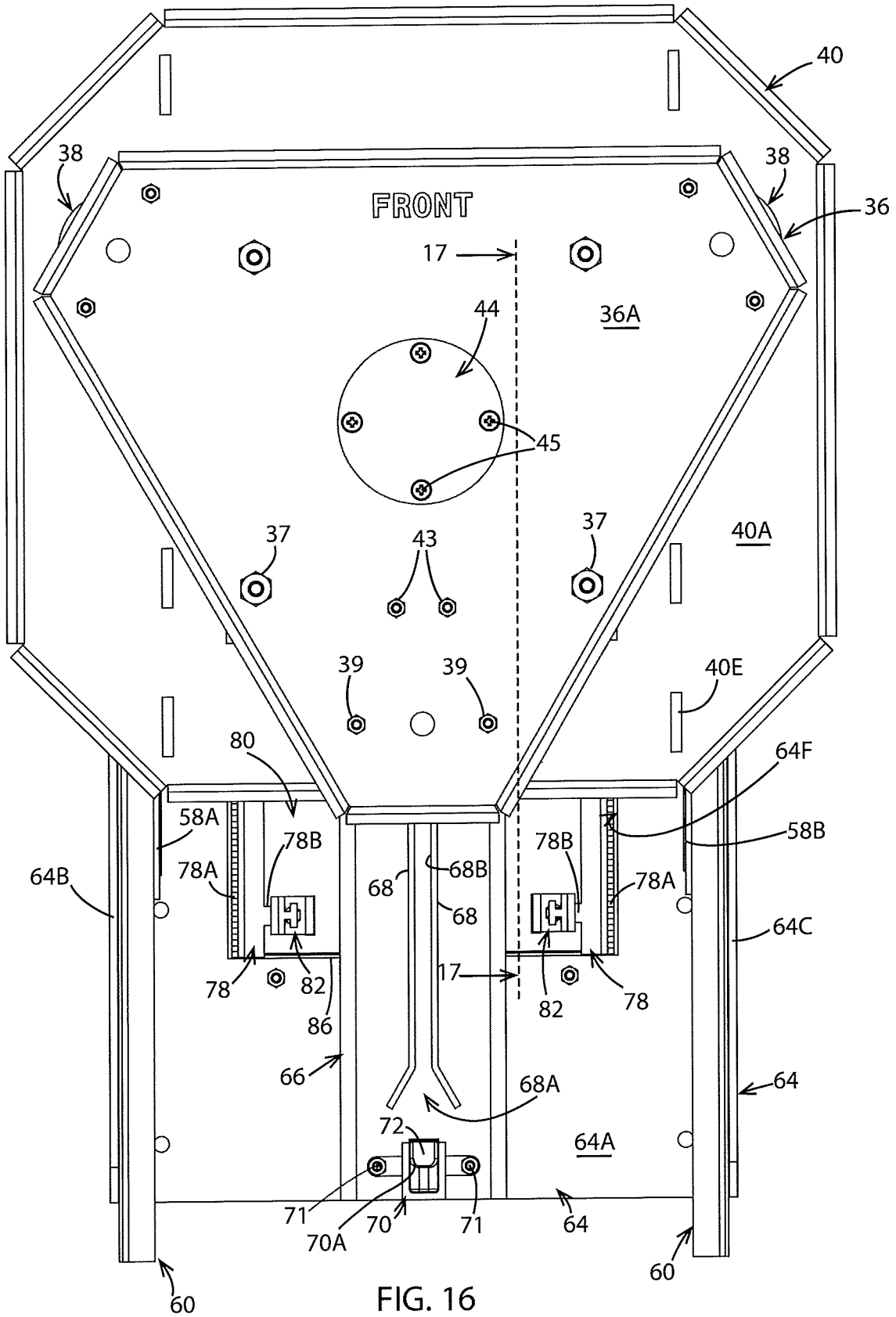
FIG. 16 (FIG. 16) is a top plan view of the adjustment assembly with the rotational mechanism thereof illustrated in the neutral position and with the sliding mechanism in a forwardmost position.
Figure 17:
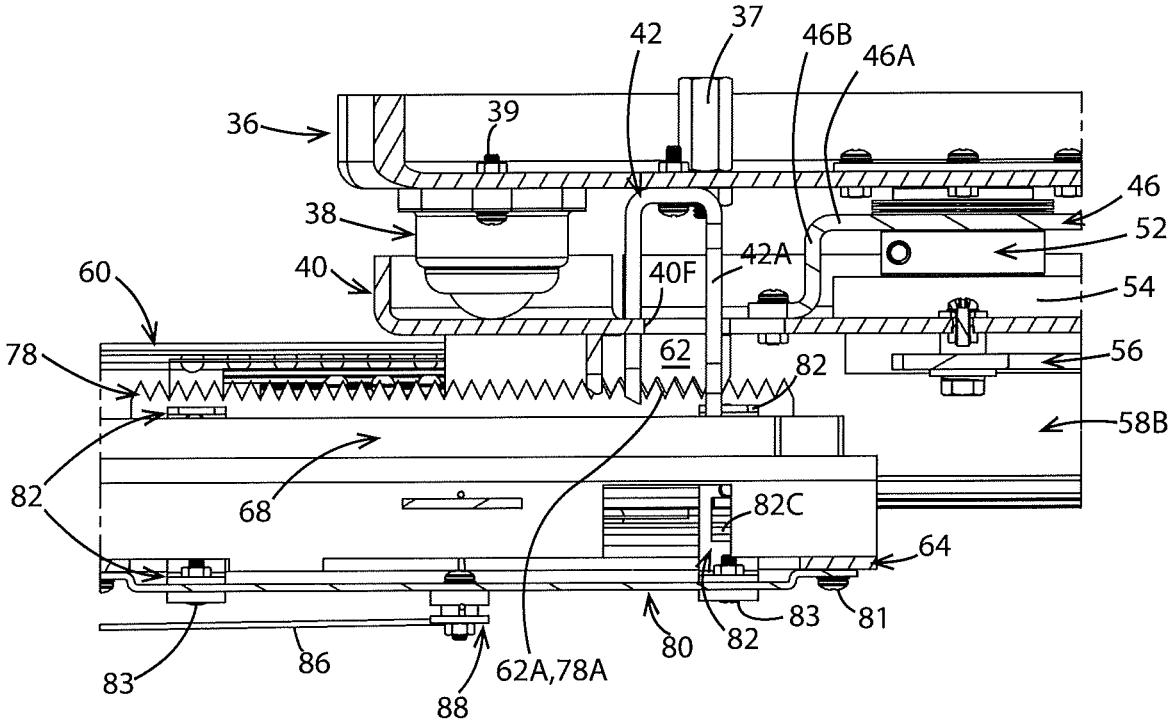
FIG. 17 (FIG. 17) is a cross-section of the adjustment assembly taken along line 17-17 of FIG. 16 and showing the sliding mechanism in a locked position.
Figure 18:
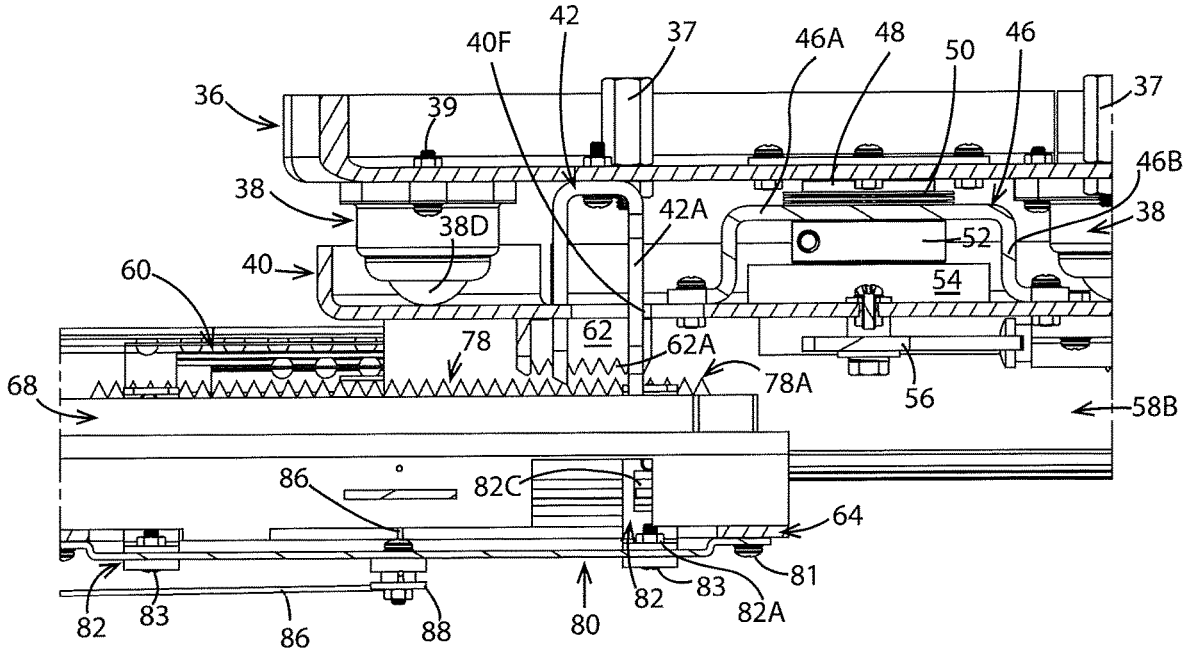
FIG. 18 (FIG. 18) is a cross-section of the adjustment assembly taken along line 17-17 of FIG. 16 but showing the sliding mechanism in an unlocked position.
Figure 19:
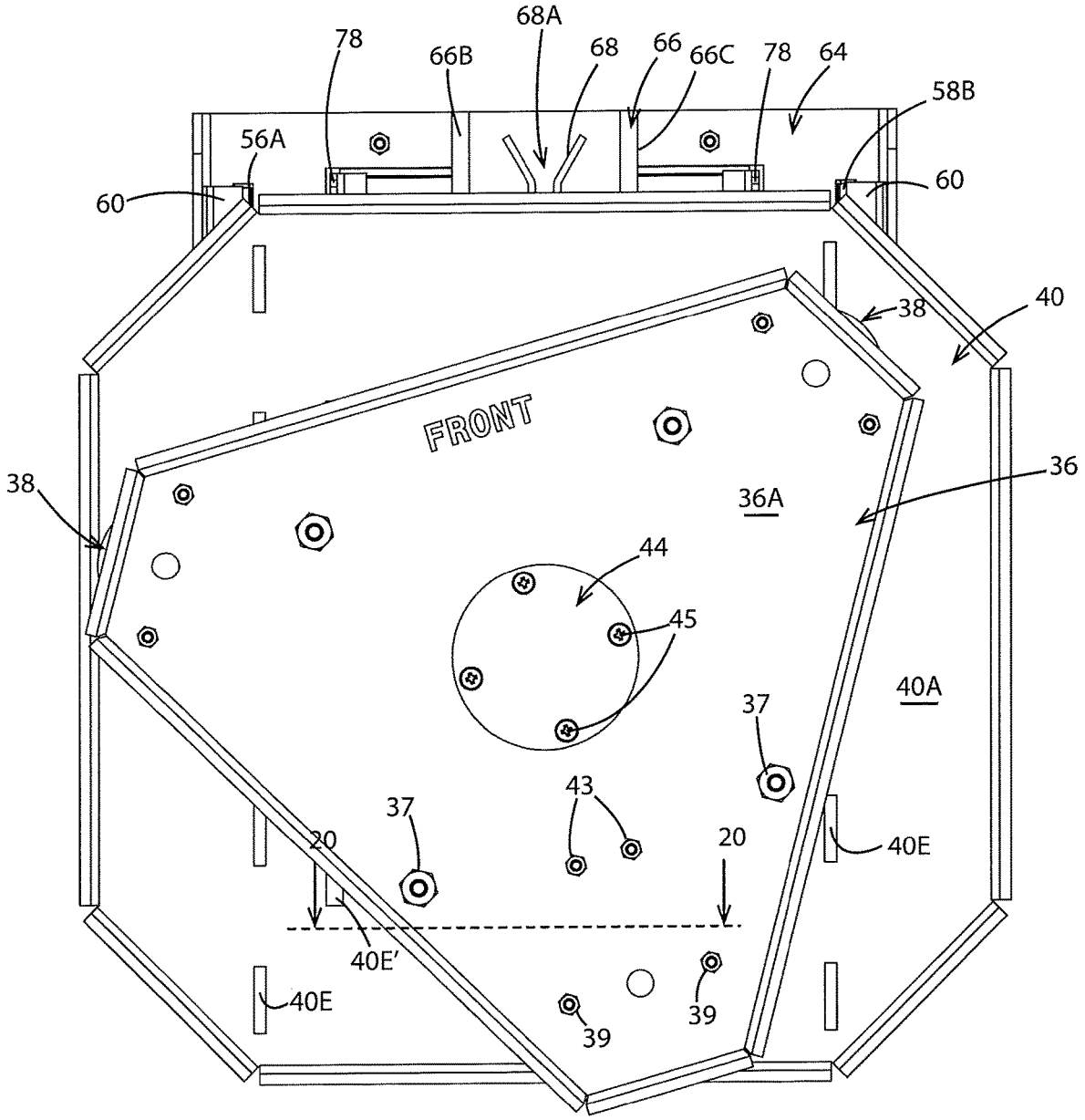
FIG. 19 (FIG. 19) is top plan view of the adjustment assembly showing the rotational mechanism in a first angled position.

A pair of anti-rotate rails 68 extend upwardly from central region 66A of rail support 66. Rails 68 are oriented parallel to each other and to longitudinal axis "Y" of chair 10, may be integral with or connected to rail support 66, and remain in a fixed orientation relative to rail support 66. Rails 68 are laterally spaced with each other. An angled rail section is provided at each end of each rail 68. Together, the angled rail sections at either end of the rails 68 form a funnel 68A (FIG. 16) that is in communication with a gap 68B defined between the longitudinally-extending portions of rails 68. A stop 70 (FIGS. 2, 4A, 4B, 16, and 23) is fixedly engaged with rail support 66 by way of a plurality of fasteners 71 and proximate a rear end thereof. The rear end of the rail support 66 is closer to the rear of the chair 10. The stop 70 includes a U-shaped region that bounds and defines a gap 70A (FIG. 16). Stop 70 is positioned proximate one end of opening 66E defined in rail support 66. The lowermost end of first leg 42A of stop 42 of rotational mechanism 32 is configured to be received within gap 68B between rails 68 when rotational mechanism 32 is in the neutral position. Sliding mechanism 34 is only able to be engaged when first leg 42A is located within this gap 68B. First leg 42A is able to slide along between rails 68 until first leg 42A of stop 42 is received in gap 70A and contacts stop 70. Stop 70 thereby limits the extent of rearward travel of sliding mechanism 34. If first leg 42A of stop 42 is engaged in gap 68B then rotation of the rotation mechanism 32 is also effectively prevented. Consequently, if it is desired to rotate seat 14, the sliding mechanism 34 must be positioned in such a way that first leg 42A is not located within gap 68B.

Figure 15:
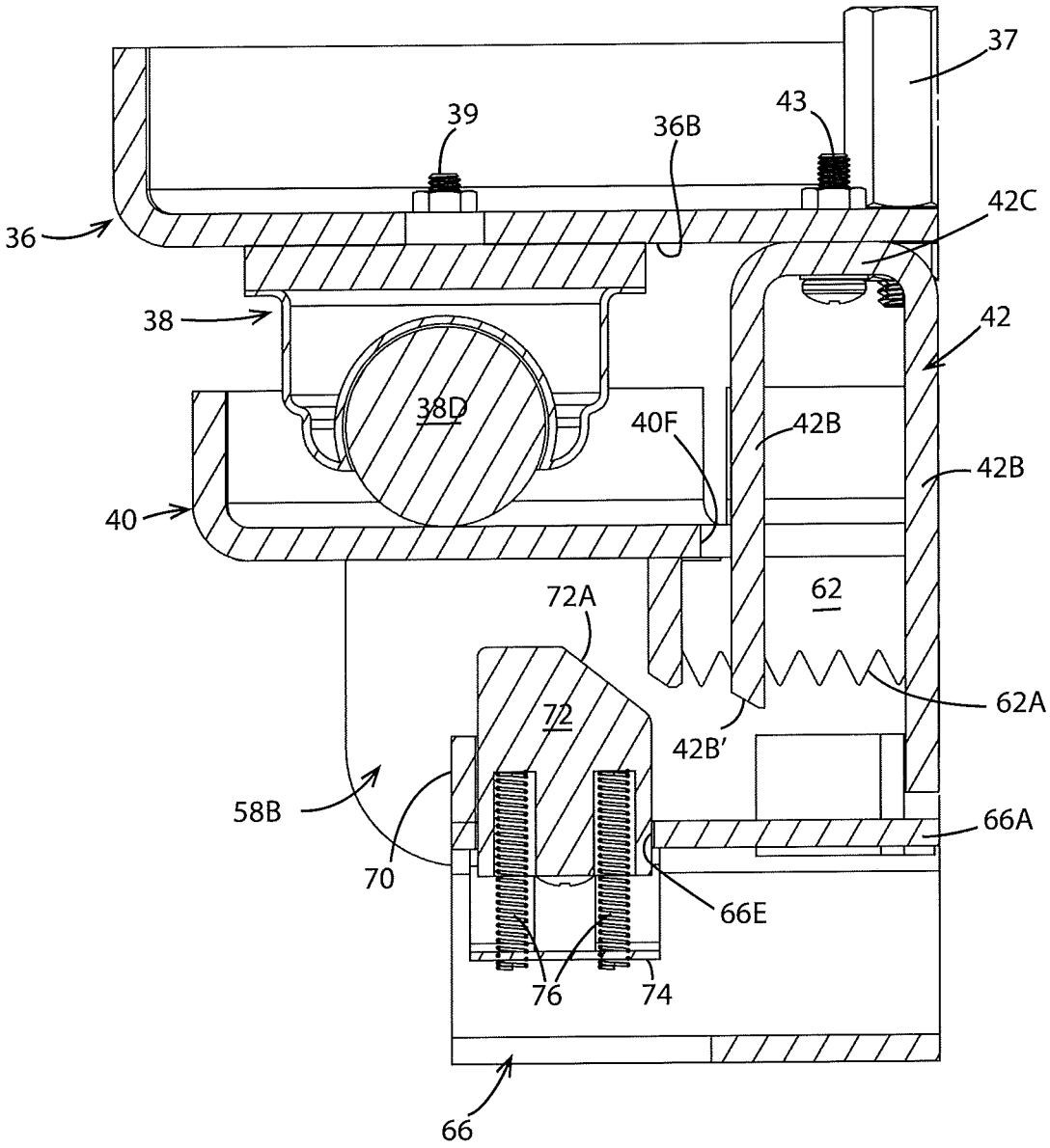
FIG. 15 (FIG. 15) is a cross-section of the rotational mechanism taken along line 15-15 of FIG. 14.

Stop 70 is located adjacent a lock plunger 72 that extends upwardly through opening 66E in rail support 66 from below. Lock plunger 72 is operatively engaged with a mounting bracket 74 that may be U-shaped and secured to the underside to central region 66A of rail support 66 by fasteners (see FIGS. 20, 23 and 24). As illustrated in these figures, the same fasteners 71 that secure stop 70 in place may be used to secure mounting bracket 74 in place as well. In other instances different fasteners may be utilized. Lock plunger 72 is located rearwardly of the rear funnel 68A on rail support 66 as shown in FIGS. 15 and 16. One or more springs 76 urge lock plunger 72 upwardly through opening 66E of rail support 66. Lock plunger 72 has an angled upper surface 72A (FIG. 13) that is inclined at an angle which is complementary to the angle on bottom end 42B' of stop 42. FIG. 15 shows lock plunger 72 in its at-rest position. In this at-rest position, springs 76 are fully expanded and a top region of lock plunger 72 extends for a first distance above an upper edge of stop 70. If seat 14 is moved linearly rearward and/or is rotated above the central axis "C" to bring stop 42 into engagement with lock plunger 72, the faceted and angled bottom end 42B' of second leg 42B of stop 42 will contact angled surface 72A. If sliding mechanism 34 is caused to move seat rearwardly, then facet "F2" may be brought into contact with surface 72A of lock plunger 72 and thereby moved lock plunger 72A downwardly toward rail support 66, thereby compressing springs 76. In other instances, rotational mechanism 32 may bring facet "F1" into contact with lock plunger 72 when seat 14 is rotated in a first direction or may bring facet "F3" into contact with lock plunger 72 when seat 14 is rotated in a second direction. In either instance, lock plunger 72 is moved downwardly toward the central region 66A of rail support 66, FIG. 13 shows a situation where the bottom end 42B" the second leg 42B has forced lock plunger 72 downward relative to an upper edge of stop 70, compressing springs 76 as it does so. As soon as seat 14 is moved linearly forwardly or is rotated so that contact between second leg 42B and lock plunger 72 is broken, lock plunger 72 will rise upwardly relative to rails 68 as springs 76 return to their original state.

A pair of lock teeth rails 78 is provided as part of sliding mechanism 34. Each lock teeth rail 78 is located laterally between one of the first and second sides 58A, 58B of rail mount assembly 58, and one of the first and second sides 66B, 66C of rail support 66. An upper edge of a vertically-oriented leg of each lock teeth rail 78 is formed into a plurality of teeth 78A. Teeth 78A are configured to selectively interlock with the teeth 62A of locking members 62 which extend downwardly from roller plate 40. Each lock teeth rail 78 includes a pair of longitudinally spaced apart flanges 78B (FIGS. 16, 20, and 23) that extend horizontally outwardly from the rail. The purpose of flanges 78B will be discussed further herein.

Figure 23:
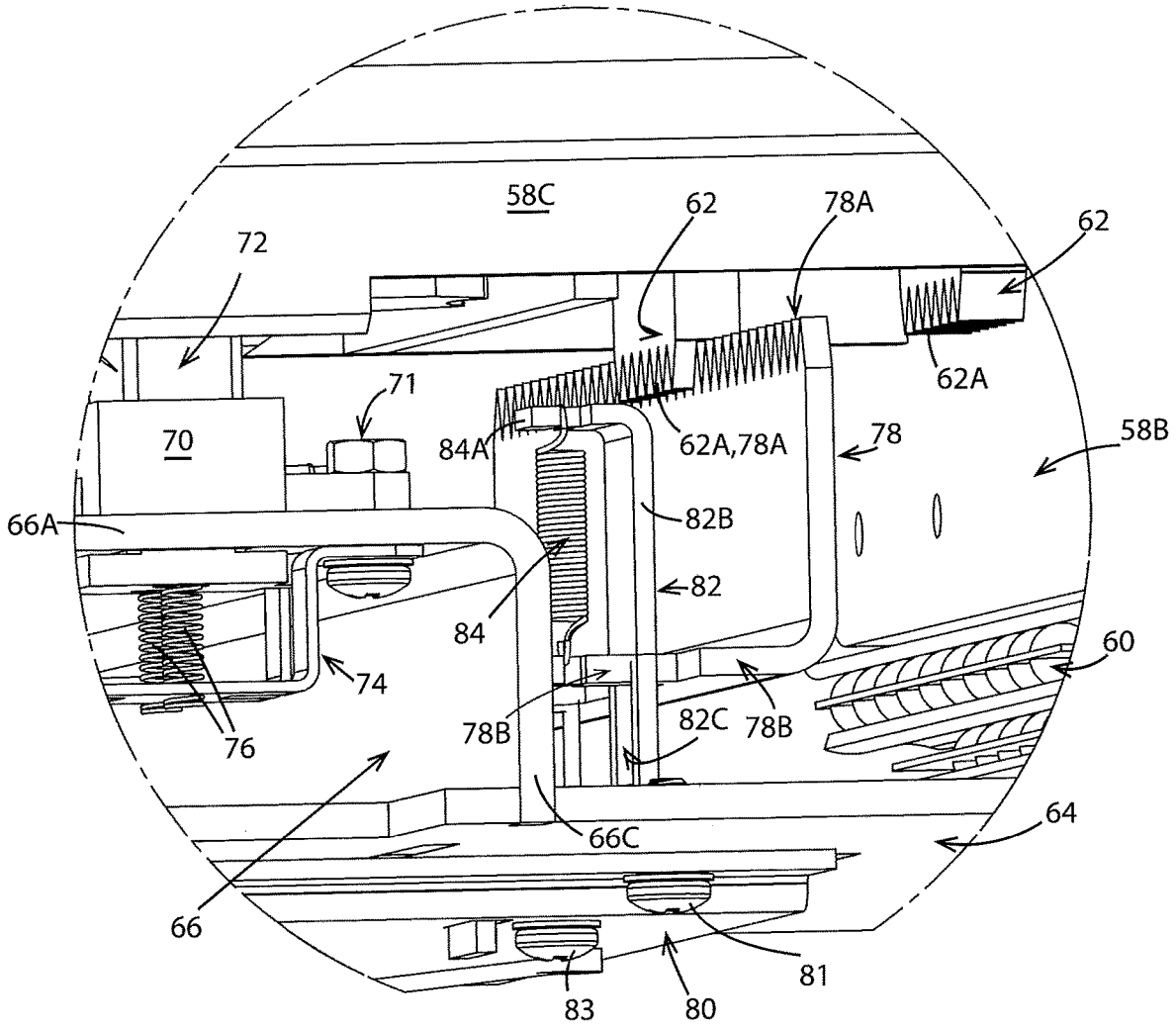
FIG. 23 (FIG. 23) is an enlarged rear perspective view of a left side lock tooth rail of the sliding mechanism shown engaged with a rail mount assembly and in the locked position.
Figure 24:
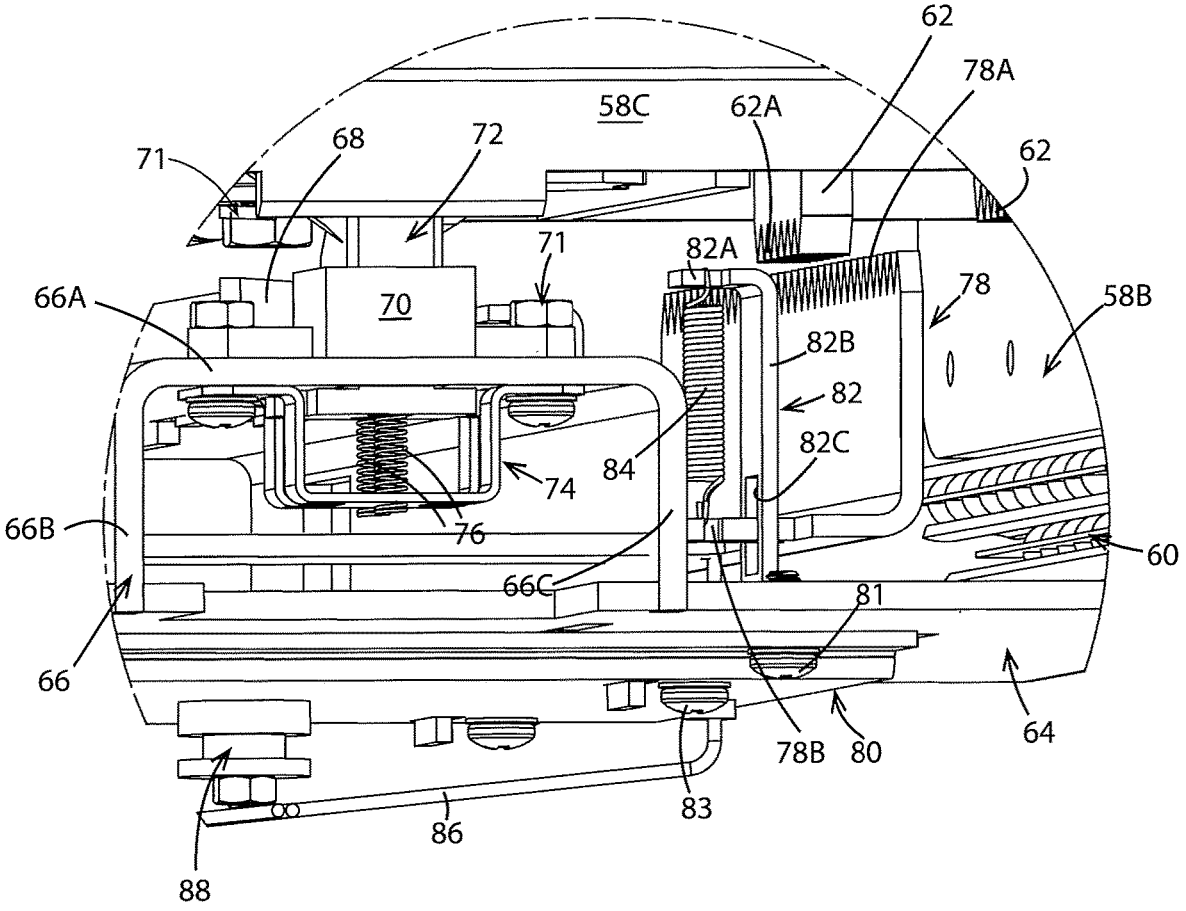
FIG. 24 (FIG. 24) is an enlarged rear perspective view of the left side lock tooth rail of the sliding mechanism shown engaged with the rail mount assembly and in the unlocked position.

Sliding mechanism 34 may only be engaged to linearly move seat 14 relative to base 28 if contact between lock teeth rails 78 and locking members 62 is broken. FIG. 23 shows the teeth 78A of one of the lock teeth rails 78 engaged with a locking member 62. In this condition, no linear motion between seat 14 and base 28 is possible. FIG. 24 shows the teeth 78A of one of the lock teeth rails 78 disengaged from locking member 62. In this condition, linear motion between seat 14 and base 28 is possible. It should be noted that both lock teeth rails 78 move upwardly or downwardly in unison with each other and therefore both lock teeth rails 78 will either be simultaneously engaged with respective sets of lock teeth 62 or will be disengaged therefrom. Engagement between the lock teeth rails 78 and locking members 62 is broken when lock teeth rails 78 are pulled downwardly when cable 26E is pulled in the direction of arrow "B" (FIG. 8) upon activation of actuator 26 (i.e., moving actuator 26 toward the underside of the first armrest 16. A release assembly is engaged to move lock teeth rails 78 out of engagement with locking members 62 as will be described hereafter.

Figure 11:
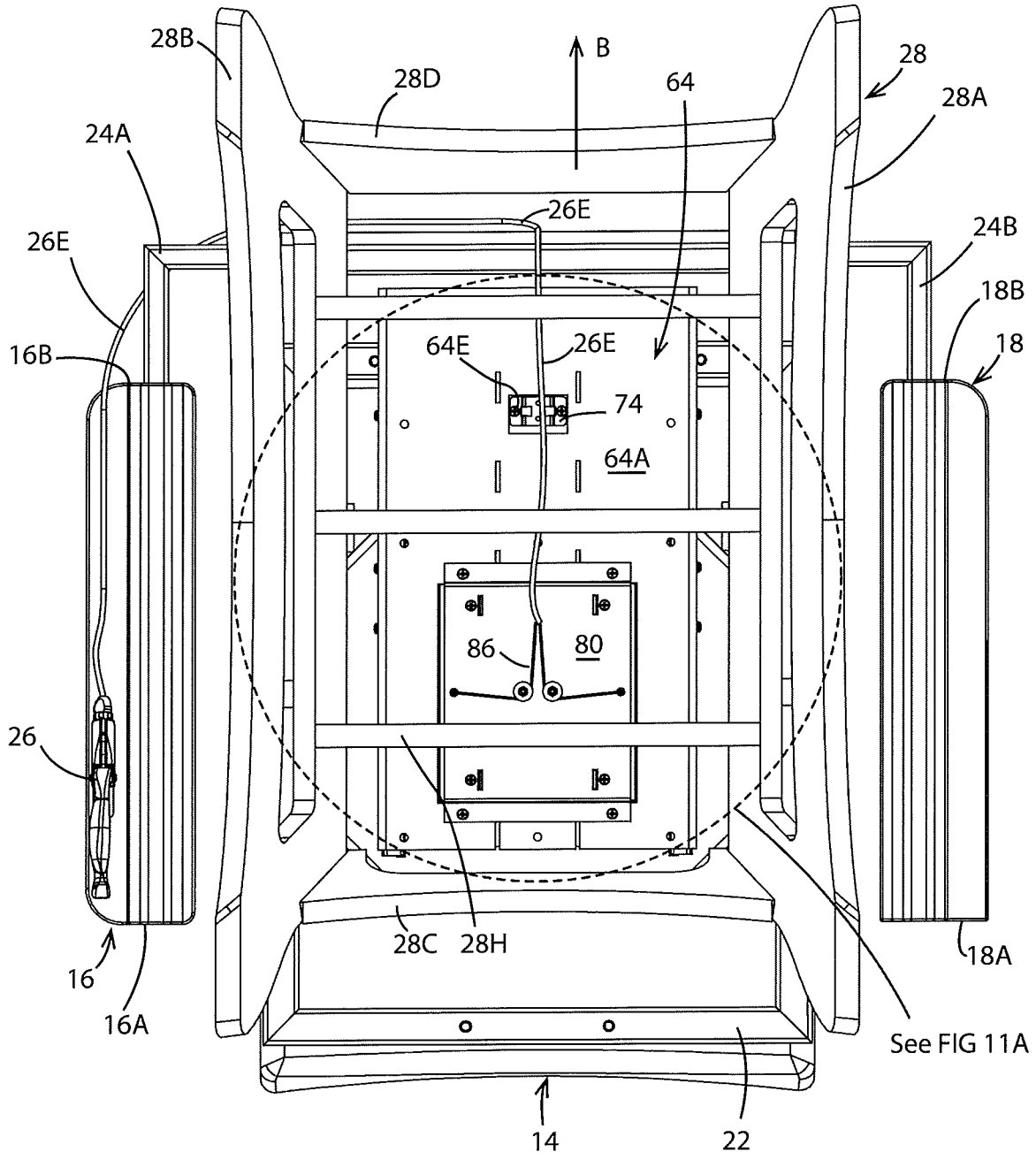
FIG. 11 (FIG. 11) is a bottom plan view of the exemplary chair.
Figure 11A:
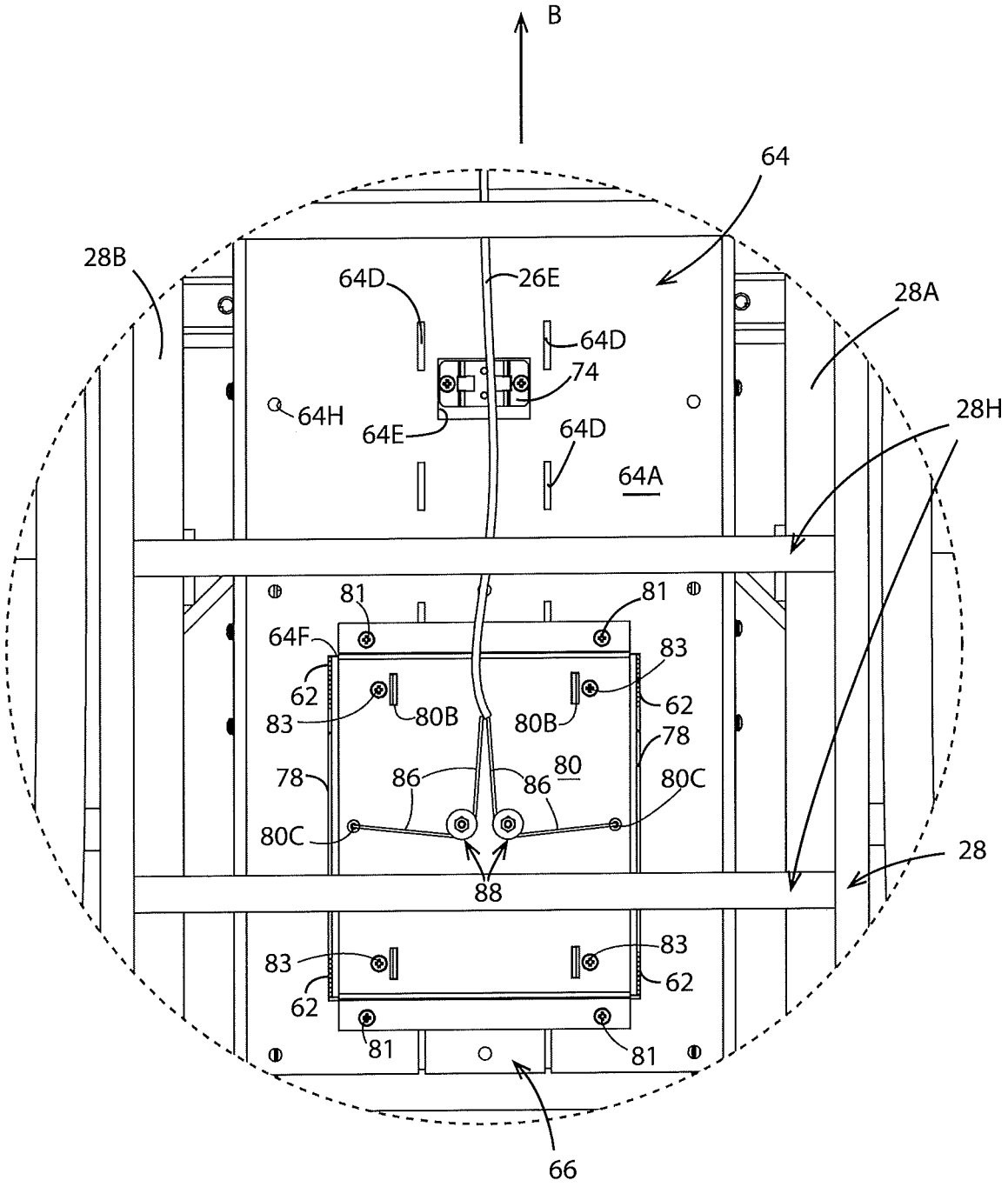
FIG. 11A (FIG. 11A) is an enlargement of the highlighted region of FIG. 11.

Sliding mechanism 34 further includes a release plate 80 (FIG. 4A, 4B, 11A) that is configured to be positioned below base frame 64 and specifically across opening 64F defined therein. Release plate 80 defines a plurality of through-holes 80A (FIG. 4B) through which fasteners 81 (FIG. 11A) extend to secure release plate 80 to base frame 64. Release plate 80 further defines a plurality of slots 80B therein and a pair of opposed through-holes 80C. The purpose of these various openings will be discussed later herein.

Sliding mechanism 34 further includes one or more release hangers 82 (FIGS. 20, 23 and 24) that are each secured to release plate 80 by a fastener 83. The portion of release plate 80 to which release hangers 82 are engaged may be somewhat flexible. Each release hanger 82 includes a upper and lower horizontal arms 82A and a vertical arm 82B that is oriented at right angles to the horizontal arms 82A and extends therebetween. The lower horizontal arm is secured to release plate 80 by fastener 83. The vertical arm 82B defines a vertically oriented aperture 82C (FIG. 24) therein. One of the horizontally-oriented flanges 78B of one of the lock teeth rails 78 is received through aperture 82C. A spring 84 extends between horizontal arm 82A and flange 78B. Spring 84 is expandable when there is relative motion between flange 78B and release hanger 82 in a first direction. Spring 84 returns to its non-expanded state when there is relative motion between flange 78B and release hanger 82 in a second direction.

Figure 14:
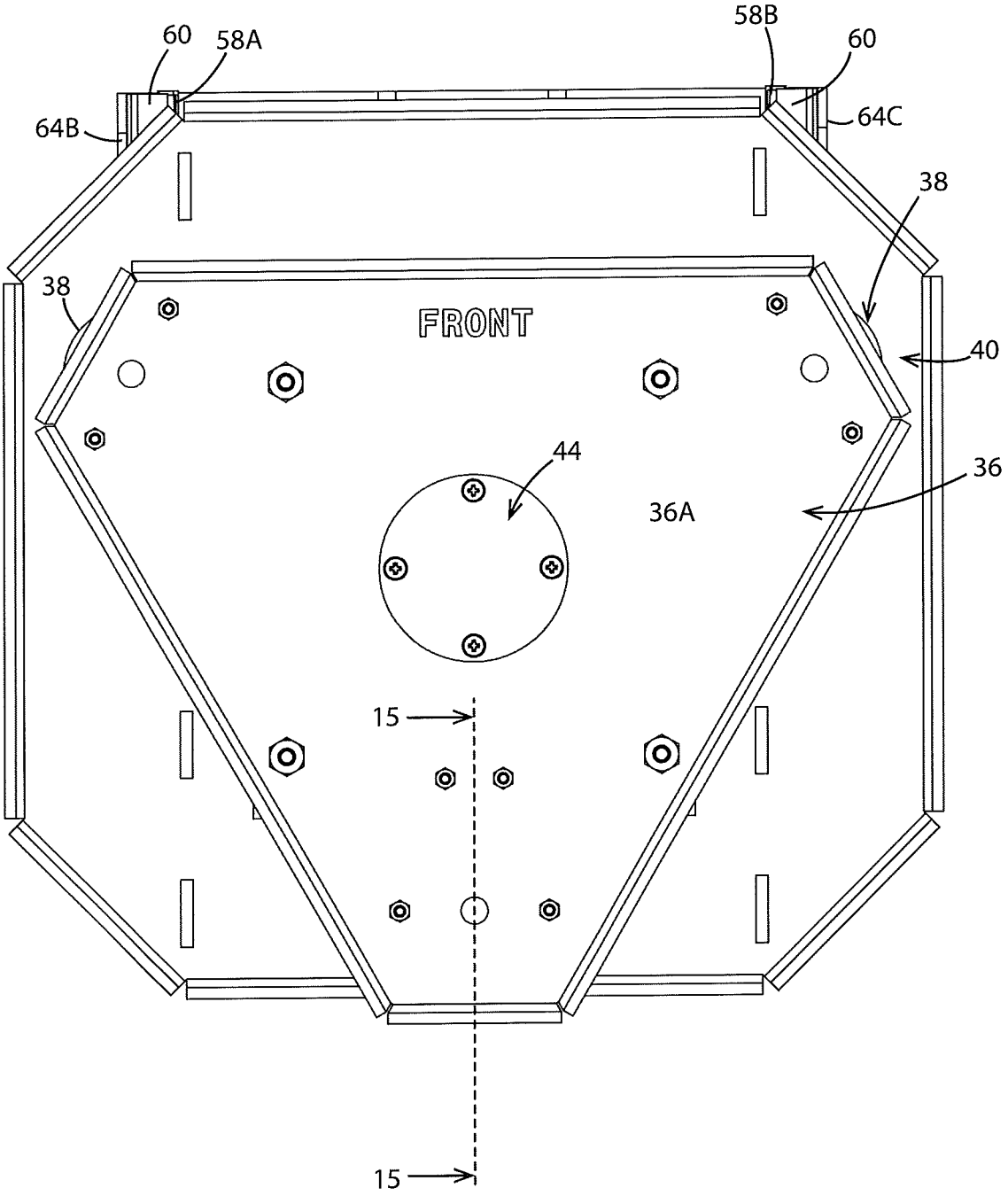
FIG. 14 (FIG. 14) is a top plan view of the adjustment assembly with the rotational mechanism thereof illustrated in in the neutral position and with the sliding mechanism moved forwardly relative to FIG. 12.

As shown in FIGS. 4A, 4B, 6A, 11A, and 20, a release cable 86 is operatively engaged with cable 26E, is threaded through holes 80C in release plate 80, and is wrapped around spindles 88 that extend downwardly below a lower surface of release plate 80. When actuator 26 is activated by moving the trigger 26C upwardly toward the underside of first armrest 16, cable 26E is pulled upwardly toward first armrest 16 in the direction of arrow "B". Cable 26E pulls release cable 86 in the direction of arrow "B", which in turn DOES WHAT Referring now to FIG. 25-28, various operational views are shown. Referring specifically to FIGS. 12-18, 25 and 26, the seat 14 and back 12 of chair 10 are operative to slide linearly in one of a first direction and a second direction that is indicated by arrow "D". The seat 14 may be moved linearly forwardly in a first direction so that a portion of the seat frame 22 projects outwardly beyond a front end of the frame 28, i.e. to a position shown in phantom in FIGS. 25 and 26. If the seat 14 is in the forwardmost position (shown in phantom in these figures), then seat 14 may be moved linearly rearwardly in a second direction relative to base 28 to the position shown in solid lines. It should be noted that base 28 remains in a constant position on a floor surface during the motion of the seat 14 in either of the first direction or second direction. This type of linear motion relative to base 28 may be undertaken if, for example, a person sitting on seat 14 wishes to move closer to a dining table, for example, or wishes to move away from the dining table. It should also be noted that linear motion is able to occur when first leg 42A of stop is positioned within the gap 68B defined between the anti-rotate rails 68. This position is attained when the rotational mechanism 32 is in the neutral position shown in FIG. 12. FIGS. 12, 14, and 16 show the sliding linear motion where the adjustment assembly 30 is viewed from above. During linear motion, rotary bracket 36 remains in a fixed orientation because first leg 42A of stop 42 is located in the gap 68B of anti-rotate rails 68. As indicated above, linear motion is only possible if lock teeth rails 78 have been previously disengaged from locking members 62. The user or caregiver will therefore depress the trigger 26C of actuator 26 toward the first armrest 16 and thereby pull cable 26E in the direction of arrow "B". The user or caregiver may then slide seat 14 relative to base 28 in the desired forward or rearward direction. If trigger 26C is released at any time, the lock teeth rails 78 will rise upwardly once again to interlocking engage with locking members 62 and prevent further linear motion. The user or caregiver is therefore able to regulate the degree of linear motion of seat 14 relative to base 28 simply by releasing trigger 26C when the desired position of seat 14 relative to base 28 is reached.

Base 28 will typically positioned a distance away from a table surface so that the user can readily get into and out of seat. In order to get in and out of seat 14, the user or the caregiver will move the seat 14 to the rearmost position relative to base 28 (FIG. 25). Because of the physical challenges faced by the user, it is important that the seat 14 does not accidentally slide linearly out of this position until it is desired to do so. Releasing the trigger 26C will ensure that the lock teeth rails 78 are firmly engaged with the locking members 62 and prevent linear motion.

Figure 21:
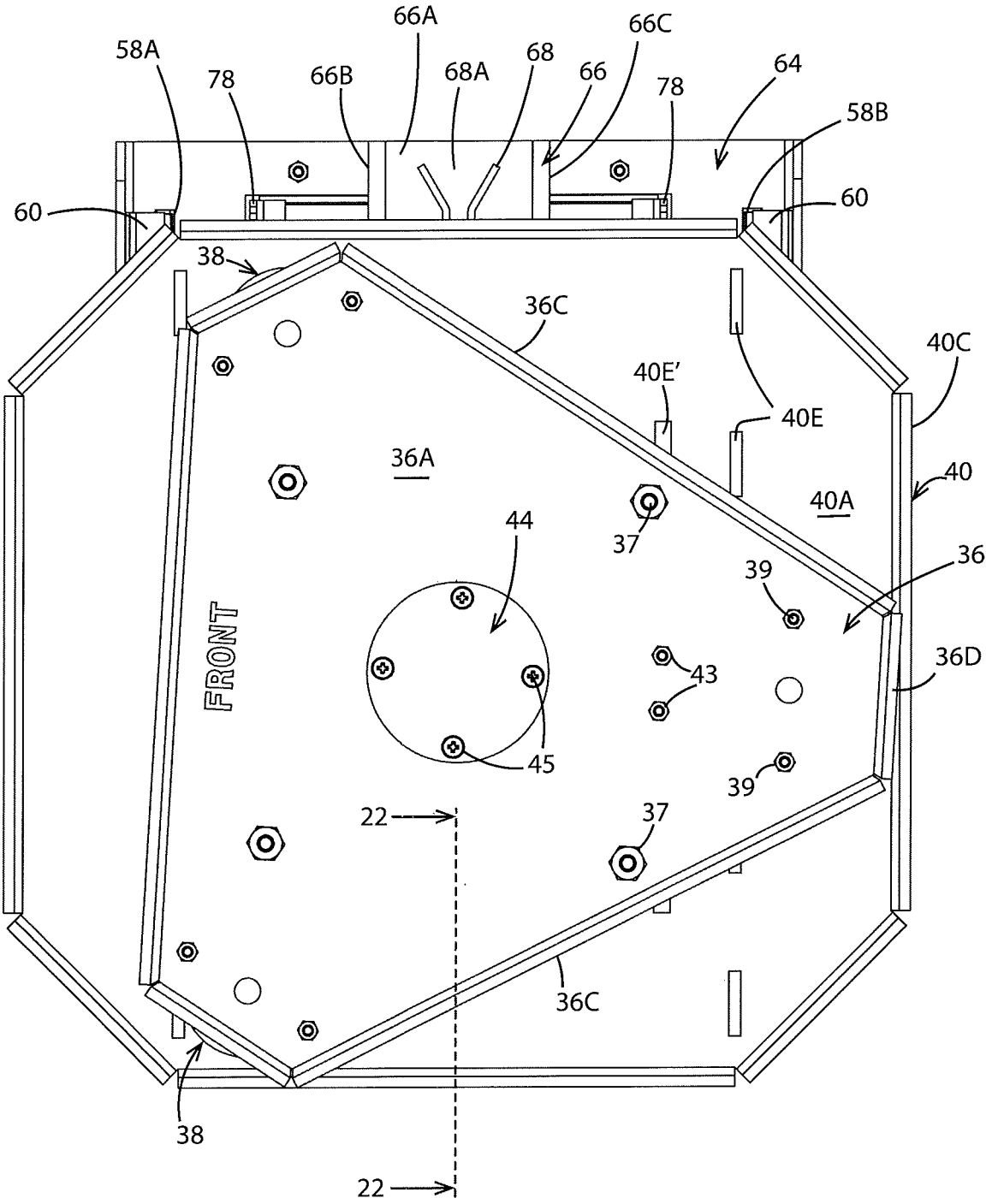
FIG. 21 (FIG. 21) is top plan view of the adjustment assembly showing the rotational mechanism in a second angled position.
Figure 22:
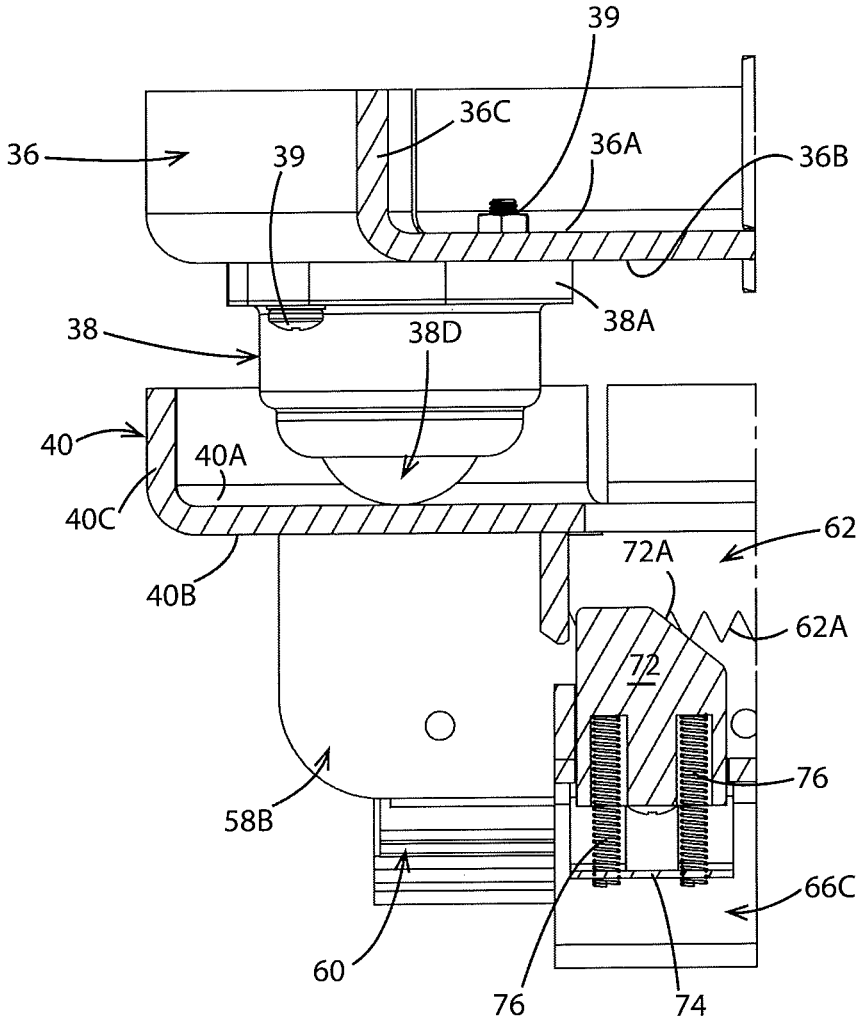
FIG. 22 (FIG. 22) is a cross-section taken along line 22-22 of FIG. 21.

If it is desired to rotate the seat 14 relative to the base 28 (FIGS. 27 and 28), stop 42 has to be located in one or other funnel 68A of anti-rotate rails 68 so that first leg 42A of stop 42 is not restrained between the anti-rotate rails 68. There are therefore only two positions were rotation of seat 14 relative to base 28 is possible; namely, when seat 14 is in its forwardmost position relative to base 28 and when seat 14 is in its rearmost position relative to base. When stop 42 is located in one of the funnels 68A, force may be applied to seat 14 to rotate the seat about central axis "5". This rotational motion causes stop 42 to ride along crescent-shaped aperture 40F as previously described herein. As indicated earlier, initially some resistance to rotating has to be overcome in order to move seat 14 out of the neutral position (FIG. 1) or out of a first angled position or a second angled position. FIGS. 21 and 22 show rotary bracket 36 (and thereby the seat 14 that is engaged therewith but not shown in these figures) rotated to a first position relative to base 28. It will be understood that rotary bracket 36 and thereby seat 14 may be rotated in the opposite direction in substantially the same manner). It is not necessary to disengage lock teeth rails 78 if it is desired to rotate seat 14. The lock teeth rails 78, in fact, aid in preventing seat 14 from sliding linearly while the user is attempting to rotate the seat 14. Therefore, referring specifically to FIGS. 27 and 28, the chair 10 is operative to be rotated in either of a first direction or opposing second direction as illustrated by arc "E after releasing trigger 26C and allowing trigger 26C to move in away from first armrest 16 and thus permitting lock teeth rails 78 to rise into engagement with locking members 62.

Because the user typically will get out of the seat 14 when in the rearmost position, lock plunger 72 may be activated when seat is in the rearmost position. The lock plunger 72 aids in preventing the stop 42 from being accidentally rotated. This is accomplished by ensuring that second leg 42B of stop 42 travels rearwardly until second leg 42B of stop 42 rides along angled face 72A and depresses lock plunger 72 (FIG. 12) until lock plunger 72 is in its lowermost position relative to the upper edge of stop 70. In response, springs 76 urge lock plunger 72 upwardly toward engagement with stop 42 and thereby retain stop 42 in the locked position between lock plunger 72 and bottom surface 36B of rotary bracket 36. Some force needs to be applied to push seat 14 forwardly so that first leg 42A enters gap 68B and off lock plunger 72. (It should be noted that a lock plunger 72 and stop 70 may be provided at one or both ends of rail support 66.)

Stop 42 is operative to rotate until it reaches one of the tapered regions 40J of crescent-shaped aperture 40F where the narrowing of the crescent 40F will provide resistance to motion. Chair 10 is configured to provide audible and tactile feedback to a user of the chair or a caregiver that the chair is locked into a position. In particular, the user or caregiver will hear and feel a "click" when the stop 42 moves past one of the shoulders 40H or into the recess 40D between detents 40E and 40F (i.e., the neutral position) and/or into one of the extreme angular positions. Motion is substantially prevented in the neutral position or extreme angular positions without additional force needing to be applied by the user or caregiver at these positions. Free rotation of seat 14 in these positions is substantially prevented. Once additional force is applied to move seat 14 out of the neutral position or extreme angular positions, rotation may occur. When the additional force is applied, the balls 38D of transfer balls 38 are caused to ride along the top surface 40A of roller plate 40 and the various bushings and roller bearings provided as part of rotational mechanism 32 help to ensure smooth rotational motion of seat 14.

A first, or a neutral position that allows the back 12 of the chair 10 to sit between and sit parallel to first and second sides 28A, 28B of base 28. The second position provides a first extreme angle as the chair 10 rotates in a first direction "E" about axis "C". In exemplary embodiments, if the neutral position is at zero degrees, the first extreme angle may be from about 54 degrees up to about 120 degrees relative to the zero degree position (i.e., the neutral position). In a further embodiment, the first extreme angle may be from about 80 degrees up to about 100 degrees relative to the zero degree position. In yet a further embodiment, the first extreme angle may be about 76 degrees relative to the zero degree position.

The seat 14 may be rotated in an opposite second direction "E" about central axis "C" to a second extreme angle or a third position. The second extreme angle is a mirror image of the first extreme angle. For example, if the neutral position is at zero degrees, the second extreme angle may be from about 240 degrees up to about 300 degrees. In a further embodiment, the second extreme angle may from about 254 up to about 280 degrees. In yet a further embodiment, the second extreme angle may around 266 degrees.

It will be understood that in other embodiments a second neutral position may be provided at a location 180 degrees relative to the neutral position disclosed herein. It will further be understood that the extreme angles can be set at any desired angle relative to the neutral position simply by changing the configuration of the aperture 40F.

In a practical situation, a chair may be rotated to an extreme angle and a user may then sit in the chair 10. The chair 10 is then rotated to the neutral position, and will feel the "click" notifying the user that the seat is centered and in the neutral position. This click is caused by the lock plunger 72 being engaged by the stop 42. The trigger 26C is then operated in a first direction (toward the first armrest 16) to unlock the seat 14 for longitudinal motion by disengaging the lock teeth rails 78. The chair 10 is then slid longitudinally to a desired location while continuing to holding down the trigger 26C. Once the seat 14 is at its desired location, the operator may release the trigger 26C. The seat 14 is locked in its desired longitudinal position by the lock teeth rails 78 re-engaging the locking members 62. Rotational motion is restricted at any longitudinal position between the extreme forwardmost position or rearmost position by the engagement between the anti-rotate rails 68 and first leg 42A of stop 42. The position of the base 28 remains the same regardless of the motion of seat 14.

It should be noted that any of the springs 76 and 84 utilized herein may be replaced by any suitable type of resilient deformable member that will enable motion in one direction when a force is applied to the components with which the deformable member is engaged but which will also return the components with which it is associated back to their original position when the force thereon is released.

In one aspect, an exemplary embodiment of the present disclosure may provide a chair 10, comprising a seat 14; a base 28 adapted to contact a surface (such as a flat floor surface); and an adjustment assembly 30 operatively engaging the seat 14 and base 28 with each other; wherein the adjustment assembly 30 comprises a first mechanism 32 operative to rotate the seat 14 with respect to the base 28 about a vertical axis "C"; and a second mechanism 34 operative to move the seat 14 linearly with respect to the base 28 (such as parallel to longitudinal axis "Y. and wherein at least one of the first mechanism 32 and the second mechanism 34 facilitates motion of the seat 14 relative to the base 28 from a reference position to one of a plurality of additional positions located remote from the reference position without moving the base relative to the surface. For example, the first mechanism 32 may move the seat 14 from the neutral position (shown in FIG. 12) to the rotated position shown in FIG. 19 or FIG. 21. The second mechanism 34 may move the seat 14 from the rearmost position FIG. 12 to a forwardmost position (FIG. 16) or to a position therebetween (FIG. 14). The base 28 base remains in a same position on the floor surface during rotation and/or linear motion of the seat 14 relative to the base 28. It should be noted that the second mechanism may be configured to move the seat laterally relative to the base instead of longitudinally or to move the seat at an angle to a lateral or a longitudinal axis, e.g. at 45 degrees relative thereto. The sliding motion will occur along a horizontal axis that is oriented at right angles to the vertical axis "C" about which the seat 14 can be rotated.

In accordance with another aspect of the present disclosure a method of adjusting a chair 10 relative to a horizontal work surface disposed a distance above a floor includes placing a base 28 of the chair 10 on the floor a first distance away from an edge of the work surface. For example, the base 28 of the chair 10 could be positioned next to a dining table but spaced a sufficient distance away from an edge of the dining table that would typically permit an able-bodied person to seat themselves in the chair. The method further includes rotating a seat 14 of the chair 10 relative to the base 28 from a neutral position (shown in FIG. 12) to a first angled position (shown in FIG. 21, for example) and then causing an individual with mobility challenges to sit in the seat 14. The method further includes rotating the seat 14 back to the neutral position (FIG. 12) from the first angled position (FIG. 21) and then moving the seat 14 linearly forwardly relative to the base 28 (and along a horizontal axis such as the longitudinal axis "Y") and toward the edge of the work surface (e.g. the dining table mentioned above). The rotating of the seat 14 relative to the base 28 and the moving of the seat 14 linearly relative to the base 28 are accomplished without moving the position of the base 28 on the floor. The method further includes locking the seat 14 in the first angled position (FIG. 12) prior to causing the individual to sit in the seat 14. This locking can include engaging a stop 42 with a lock plunger 72 and/or frictionally engaging a pair of legs 40A, 40B in a narrowing tip of an arcuate aperture in a roller plate; and/or moving a first leg 40A of a stop 40 toward a second leg 40B while causing the stop 40 to move past a detent 40E, for example, extending into an aperture 40F along which the stop 40 travels.

The method further includes preventing rotation of the seat 14 about a vertical axis "C" prior to moving the seat 40 linearly relative to the base 28. The method may further include disengaging a locking mechanism that restrains the seat 14 against linear motion prior to moving the seat linearly. The disengaging may include moving a lock teeth rail 78 away from a locking member 62 (or vice versa) in order to break an interlocking engagement between teeth 78A of the lock teeth rail 78 and teeth 62A of locking member 62.

It will be understood that for the individual to get out of chair 10, the steps of the method are reversed. So, the lock teeth rail 72 will be reengaged with the locking member 62, the seat 14 will be moved linearly in the opposite direction relative to the base 28 and away from the work surface. When the seat is back in the rearmost position relative to the base, the seat will be rotated relative to the base from the neutral position to the angled position and then the individual can be moved off the seat 14.

It will be understood that in some instances the seat can be rotated when closer to the work surface (provided the stop 42 is in the funnel 68A and out from the gap 68B between the anti-rotate rails 68). Additionally, the linear motion of the seat can be stopped by simply releasing the actuator at any point to bring the lock teeth rail 78 into contact with the locking member 62. The force to rotate the chair and/or linearly move the chair may be provided by the individual seated in the seat or by someone standing next to the chair.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A method of adjusting a chair relative to a work surface disposed a distance above a floor comprising:

placing a base of the chair on the floor a first distance away from an edge of the work surface;

rotating a seat of the chair relative to the base from a neutral position to a first angled position;

causing an individual to sit in the seat;

rotating the seat back to the neutral position from the first angled position;

moving the seat linearly forwardly relative to the base and toward the edge of the work surface; where the rotating of the seat relative to the base and the moving of the seat linearly relative to the base is accomplished without moving the base on the floor; and preventing linear motion when the seat is moved to a desired location while still permitting rotational movement with a first locking mechanism comprising at least one lock teeth rail and at least one locking member; wherein the at least one lock teeth rail includes teeth that interlock with teeth on the at least one locking member; and wherein the at least one lock teeth rail is moved away from the at least one locking member to permit linear motion of the seat relative to the base.

2. The method according to claim 1, further comprising:

locking the seat in the first angled position prior to causing the individual to sit in the seat.

3. The method according to claim 1, further comprising:

preventing rotation of the seat prior to moving the seat linearly relative to the base with a second locking mechanism.

4. The method according to claim 1, further comprising:

disengaging a first locking mechanism that restrains the seat against linear motion prior to moving the seat linearly.

5. A chair, comprising:

a seat;

a base adapted to rest on a surface;

an adjustment assembly operatively engaging the seat and the base;

wherein the adjustment assembly enables the seat separately to rotate relative to the base about a vertical axis and move linearly with respect to the base along an axis oriented at right angles to the vertical axis;

a first locking mechanism for selectively preventing linear motion of the seat relative to the base while permitting rotational motion of the seat relative to the base; wherein the first locking mechanism includes at least one lock teeth rail and at least one locking member; wherein the at least one lock teeth rail includes teeth that interlock with teeth on the at least one locking member; and wherein the at least one lock teeth rail is moved away from the at least one locking member to permit linear motion of the seat relative to the base;

a second locking mechanism with a pair of anti-rotate rails defining a gap therebetween and into which gap a portion of a stop provided on the adjustment assembly is received; and wherein rotational motion and linear motion of the seat relative to the base is accomplished without moving the base relative to the surface.

6. A chair, comprising:

a seat;

a base adapted to rest on a surface;

an adjustment assembly operatively engaging the seat and the base; including a first mechanism operative to rotate the seat with respect to the base about the vertical axis; and a second mechanism operative to move the seat linearly with respect to the base along a horizontally-oriented axis;

wherein a portion of the first mechanism defines an aperture therein that is crescent-shaped aperture; and wherein the first mechanism further includes a stop that travels along the aperture during rotational motion; and at least one detent extending into the crescent-shaped aperture and past which the stop travels during rotational motion; and wherein the at least one detent slows down the rotational motion;

wherein the adjustment assembly enables the seat separately to rotate relative to the base about a vertical axis and move linearly with respect to the base along an axis oriented at right angles to the vertical axis; and wherein rotational motion and linear motion of the seat relative to the base is accomplished without moving the base relative to the surface.

7. The chair according to claim 6, wherein each of the first mechanism and the second mechanism facilitates motion of the seat relative to the base from a reference position to one of a plurality of additional positions located remote from the reference position without moving the base relative to the surface.

8. The chair according to claim 6, further comprising:

an actuator operatively engaged with the second mechanism, said actuator being movable between an actuated position where linear motion of the seat relative to the base is enabled, and a non-actuated position where linear motion of the seat relative to the base is prevented.

9. The chair of claim 6, wherein the first mechanism includes a one or more transfer balls that move across a roller plate.

10. The chair of claim 6, further comprising a first region adjacent the crescent-shaped aperture where the stop temporarily resists the rotational motion.

11. The chair of claim 10, wherein the first region is a neutral position where at least one side of the seat is generally longitudinally aligned with at least one side of the base.

12. The chair of claim 11, further comprising a second region adjacent the crescent-shaped aperture where the stop temporarily resists the rotational motion; and wherein the second region is located at an angle relative to the first region; and where the at least one side of the seat is oriented at the angle relative to the at least one side of the base.

13. The chair of claim 6, wherein the at least one detent is operative to provide audible and tactile feedback to a user that the chair is prevented from moving freely.

14. The chair of claim 6, further comprising a first locking mechanism for selectively preventing linear motion of the seat relative to the base while permitting rotational motion of the seat relative to the base.

15. The chair of claim 14, further comprising a second locking mechanism for selectively preventing rotational motion of the seat relative to the base while permitting linear motion of the seat relative to the base.

16. The chair of claim 14, wherein the first locking mechanism includes at least one lock teeth rail and at least one locking member; wherein the at least one lock teeth rail includes teeth that interlock with teeth on the at least one locking member; and wherein the at least one lock teeth rail is moved away from the at least one locking member to permit linear motion of the seat relative to the base.

17. The chair of claim 16, wherein the second locking mechanism includes a pair of anti-rotate rails defining a gap therebetween and into which gap a portion of a stop provided on the adjustment assembly is received.

* * * * *